US011731438B2

(12) United States Patent
Kamio et al.

(10) Patent No.: US 11,731,438 B2
(45) Date of Patent: Aug. 22, 2023

(54) PRINTING APPARATUS INCLUDING SENSOR FOR CONTROLLING MOTORS

(71) Applicant: CANON KABUSHIKI KAISHA, Tokyo (JP)

(72) Inventors: Yuki Kamio, Kanagawa (JP); Ryo Kobayashi, Kanagawa (JP); Kenji Sugiyama, Kanagawa (JP); Waichiro Saiki, Kanagawa (JP); Tomohiro Suzuki, Kanagawa (JP); Takeshi Koda, Kanagawa (JP); Toshiro Sugiyama, Kanagawa (JP); Tomoyuki Nagase, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/458,800

(22) Filed: Aug. 27, 2021

(65) Prior Publication Data

US 2022/0097416 A1 Mar. 31, 2022

(30) Foreign Application Priority Data

Sep. 30, 2020 (JP) ..... 2020-166111

(51) Int. Cl.

| | |
|---|---|
| ***B41J 11/00*** | (2006.01) |
| ***B41J 15/04*** | (2006.01) |
| ***B41J 13/00*** | (2006.01) |
| ***B41J 11/70*** | (2006.01) |
| *B41J 29/38* | (2006.01) |

(52) U.S. Cl.

CPC ..... *B41J 11/007* (2013.01); *B41J 11/70* (2013.01); *B41J 13/009* (2013.01); *B41J 15/042* (2013.01); *B41J 15/048* (2013.01); *B41J 29/38* (2013.01)

(58) Field of Classification Search

CPC ..... B41J 11/007; B41J 15/048; B41J 15/042; B41J 29/38; B41J 13/009; B41J 11/70

See application file for complete search history.

(56) References Cited

U.S. PATENT DOCUMENTS

| | | | | |
|---|---|---|---|---|
| 4,523,807 | A | 6/1985 | Suzuki | |
| 5,694,330 | A | 12/1997 | Iwamura et al. | |
| 6,321,182 | B1 | 11/2001 | Suzuki | |
| 7,731,904 | B2 | 6/2010 | Okamoto et al. | |
| 9,248,445 | B2 | 2/2016 | Okamoto et al. | |
| 2012/0281037 | A1* | 11/2012 | Toya | B41J 15/04 347/16 |

FOREIGN PATENT DOCUMENTS

| | | | |
|---|---|---|---|
| JP | 2008-059161 | A | 3/2008 |

* cited by examiner

*Primary Examiner* — Henok D Legesse
(74) *Attorney, Agent, or Firm* — Venable LLP

(57) ABSTRACT

A printing apparatus, comprises a first circuit board configured to control a first motor and a printing unit that performs printing to a print medium, a second circuit board configured to control a second motor, a sensor configured to output a sensor signal used to control the first motor and the second motor, and a signal line configured to input the sensor signal from the sensor to the first circuit board and the second circuit board.

17 Claims, 20 Drawing Sheets

FIG. 7B

| USAGE SENSOR | STEP | SENSOR INPUT DESTINATION | CONTROL MOTOR |
|---|---|---|---|
| BRIDGING FLAP SENSOR 521 | S704 | CONTROLLER B 514 | BRIDGING FLAP MOTOR 518 |
| | S710 | CONTROLLER B 514 | BRIDGING FLAP MOTOR 518 |
| | | CONTROLLER A 503 | CONVEYANCE MOTOR A 508 |

FIG. 15B

| USAGE SENSOR | STEP | SENSOR INPUT DESTINATION | CONTROL MOTOR |
|---|---|---|---|
| DISCHARGE ROLLER ROTATION DETECTION SENSOR 520 | S1505 | CONTROLLER B 514 | CONVEYANCE MOTOR B 517 |
| ENCODER SENSOR 513 | S1511 | CONTROLLER A 503 | CONVEYANCE MOTOR A 508 |
| DISCHARGE ROLLER ROTATION DETECTION SENSOR 520 | | | CONVEYANCE MOTOR B 517 |

PRINTING APPARATUS INCLUDING SENSOR FOR CONTROLLING MOTORS

BACKGROUND OF THE INVENTION

Field of the Invention

The present invention is related to a printing apparatus having a plurality of control substrates.

Description of the Related Art

Typically, a printing apparatus such as an ink-jet printer comprises a plurality of sensors and actuators internally, and each sensor and actuator is connected to and controlled by a controller. However, merely by connecting a plurality of sensors and actuators to a controller, the number of sensors and the number of connectors increases and leads to increases in costs.

Japanese Patent Laid-Open No. 2008-059161, in order to solve this problem, proposes a technique for reducing costs by devising a connection configuration for inputting a sensor signal into a controller, and by inputting sensor signals into a controller serially rather than in parallel, minimizing wiring within devices.

However, even without employing such a method, it is possible to reduce costs if the number of sensors can be reduced by controlling multiple operations by the same sensor.

Consider the case where driving circuitry for a plurality of motors of an ink-jet printer, for example, is constructed by respectively separate substrates. In order to reduce the number of sensors as described above, it is effective to control the motors connected to respective substrates by using one sensor signal. However, if the driving circuitry is constructed by a plurality of substrates, it is typical to arrange controllers individually for each substrate to reduce the number of ports between the substrates and to make control easier. Accordingly, when one sensor signal is employed commonly for control of a plurality of substrate motors, the sensor signal must first be inputted into one substrate, and then that signal is delivered by communication between the controllers of the respective substrates, and used for control in the respective substrates. Accordingly, there is the problem that due to the time that it takes for communication, a delay in control of the motors connected to the substrates occurs.

SUMMARY OF THE INVENTION

The present invention was conceived in consideration of the above-described problem, and provides a printing apparatus that, in the case where a sensor signal is used commonly for control of a plurality of motors controlled by different substrates, can accelerate motor control.

According to an aspect of the present invention, there is provided a printing apparatus, comprising: a first circuit board configured to control a first motor and a printing unit that performs printing to a print medium; a second circuit board configured to control a second motor; a sensor configured to output a sensor signal used to control the first motor and the second motor; and a signal line configured to input the sensor signal from the sensor to the first circuit board and the second circuit board.

Further features of the present invention will become apparent from the following description of exemplary embodiments with reference to the attached drawings.

BRIEF DESCRIPTION OF THE DRAWINGS

FIG. 7B is a view that describes the method for controlling each step of a sensor that is used in the first embodiment.

FIG. 15B is a view that describes the method for controlling each step of a sensor that is used in the first embodiment.

DESCRIPTION OF THE EMBODIMENTS

Figure 1:
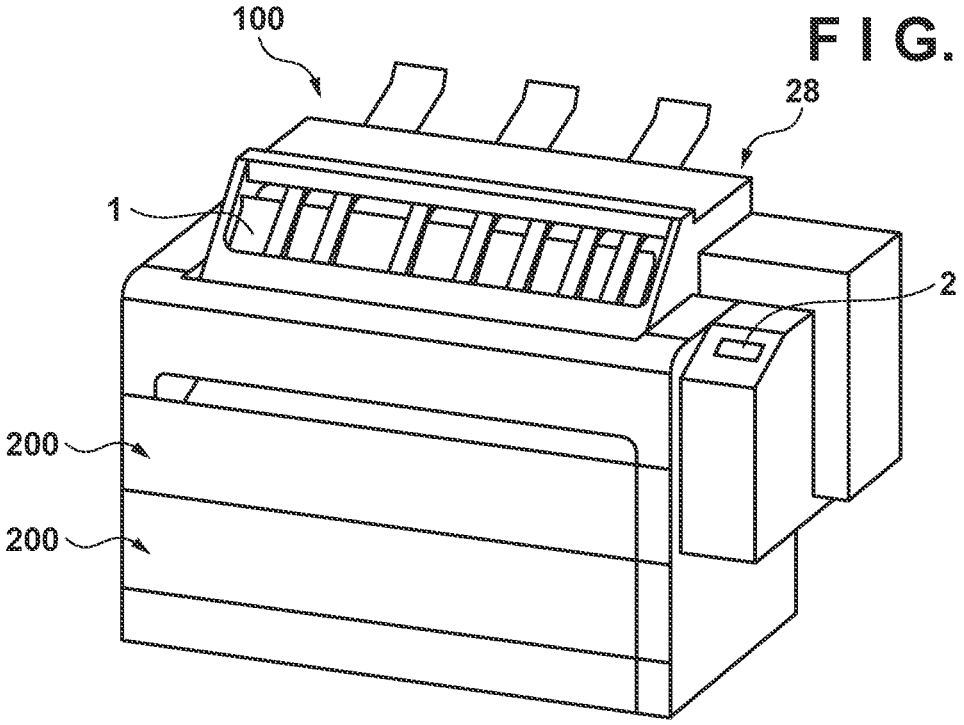
FIG. 1 is a perspective view of a printing apparatus during top surface sheet discharge in a first embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate.

Furthermore, in the attached drawings, the same reference numerals are given to the same or similar configurations, and redundant description thereof is omitted.

First Embodiment

<Basic Configuration of Apparatus>

FIG. 1 to FIG. 5 are views illustrating a configuration of a printing apparatus which is a first embodiment of a printing apparatus of the present invention. The printing apparatus of the embodiment is an ink-jet printing apparatus comprising a sheet supply apparatus for supplying sheets as print mediums (print media), a printing unit for printing an image on a sheet; and a discharge unit for selectively discharging sheets to two locations: a printing apparatus top surface unit and a printing apparatus front surface unit.

FIG. 1 is a schematic view of top surface sheet discharge in the printing apparatus 100 in which two roll sheets, in which sheets 1 are wound in a rolled shape, can be set. An image is printed on sheets 1 that are selectively pulled out from the two roll sheets set in sheet supply apparatuses 200 which are arranged above/below each other. A sheet, after printing thereon has completed, is discharged to a stacker 28 which is arranged on the top part of the printing apparatus. The user, using various switches or the like that an operation panel 2 comprises, can input various commands to the printing apparatus 100 such as a designation of the size of the sheet 1, online/offline switching, and setting of the discharge destination.

Figure 2:
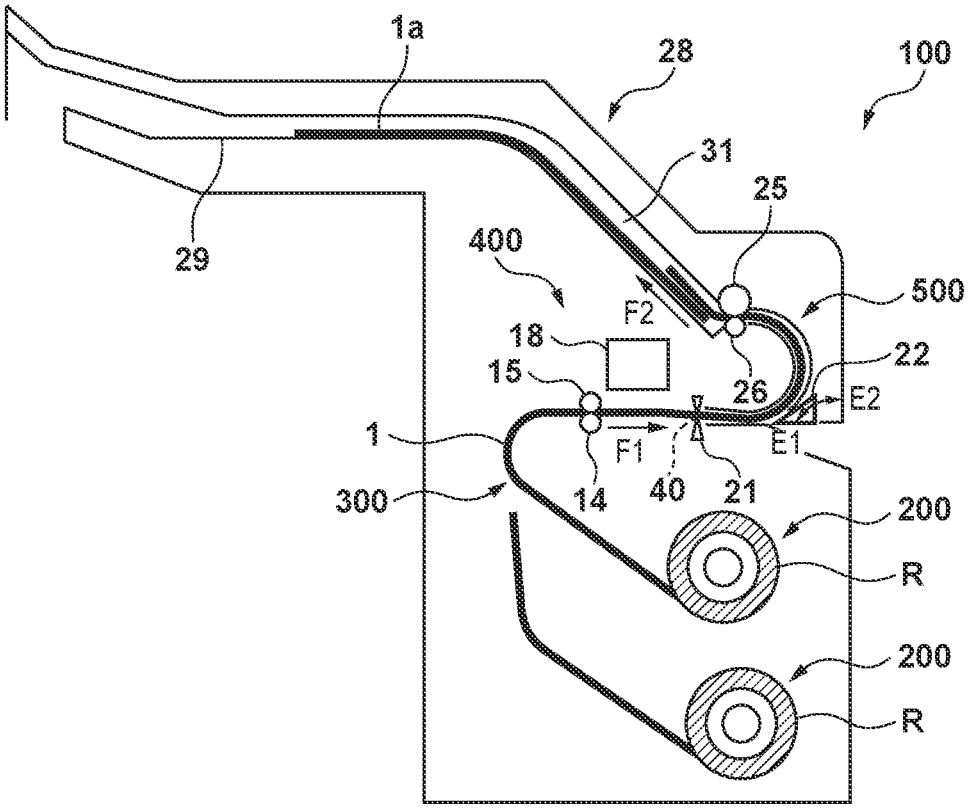
FIG. 2 is a view for describing a sheet conveyance path in a printing apparatus during top surface sheet discharge.

FIG. 2 is an overview cross-sectional view of top surface sheet discharge of a main part of the printing apparatus 100. The two sheet supply apparatuses 200 corresponding to two rolls R are disposed above/below each other. A sheet 1 pulled out from the roll R by the sheet supply apparatus 200 is conveyed to a printing unit 400, which can print an image, along a sheet conveyance path by a sheet conveyance unit (conveyance mechanism) 300. The printing unit 400, by discharging ink from an ink-jet printhead 18, an image is printed on the sheet 1. The printhead 18 discharges ink from a discharging port by using a discharge energy generating element such as an electrothermal transducing element (heater) or a piezoelectric element. The printhead 18 is not limited to the inkjet method, and the print method of the printing unit 400 is not limited. For example, a serial scan method or a full-line method or the like may be employed. In the case of a serial scan method, an image is printed in conjunction with an operation for conveying the sheet 1 and scanning of the printhead 18 in a direction that intersects the direction of conveyance of the sheet 1. In the case of a full-line method, a long printhead 18 that extends in a direction intersecting the direction of conveyance of the sheet 1 is employed, and while continuously conveying the sheet 1, the images are printed.

The sheet 1 guided to the printing unit 400 is conveyed in the direction of conveyance indicated by the arrow F1 by a conveyance roller 14. A nip roller (driven roller) 15 can rotate by being driven following the rotation of the conveyance roller 14. A cutter 21 is arranged on the downstream side of the direction of conveyance (direction of the arrow F1) of the printhead 18, and operates when printing ends to cut the sheet 1. Note that at a position that substantially overlaps this cutter 21, a bridging flap 40 (refer to FIG. 6) that will be described later is arranged. Further on the downstream side of the cutter 21, a sheet discharge switching flap 22 that can rotate in the directions of the arrows E1 and E2 in the figure is arranged, and its position is switched based on control by the controller. During a top surface sheet discharge, the sheet discharge switching flap 22 is positioned at a location where it is rotated to the direction of the arrow E1. The sheet 1 that passed through the sheet discharge switching flap 22 is discharged, by a top surface discharge unit 500, to the stacker 28 which is provided at the top part of the printing unit 400. Between the top surface discharge unit 500 and the stacker 28, a discharge roller 25 and a sheet discharge nip roller (driven roller) 26 is provided, and the sheet discharge nip roller 26 hold a cut sheet 1 and discharges it in the sheet discharge direction indicated by the arrow F2. Discharged sheets 1 are held on the stacker 28, and are stacked on top of a tray 29 and stacked sheets 1*a*.

Figure 3:
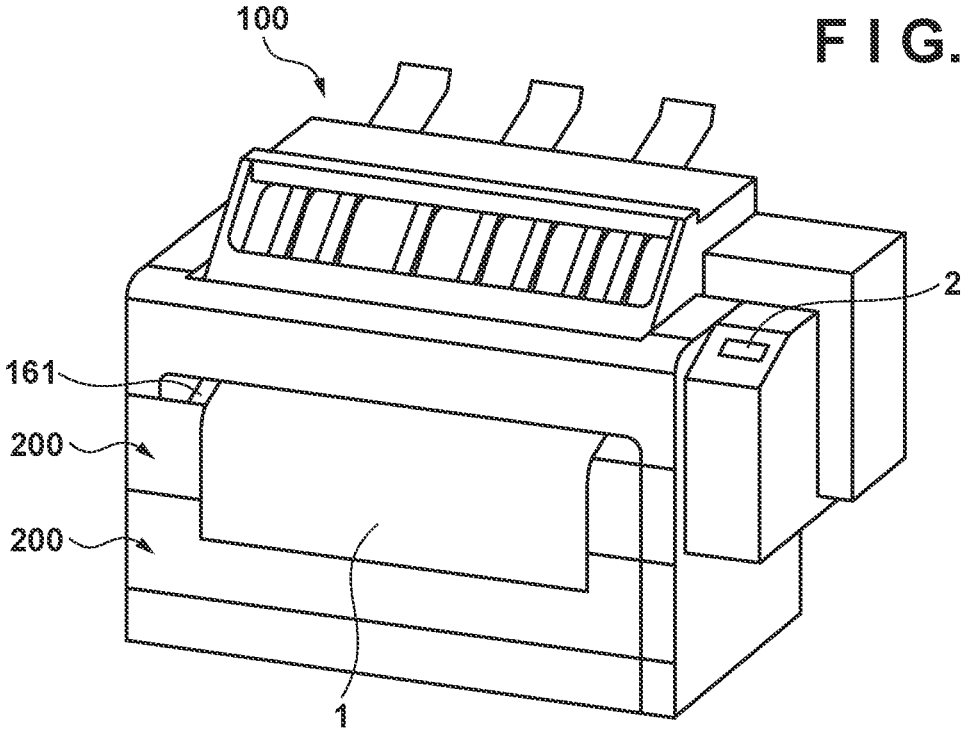
FIG. 3 is a perspective view of a printing apparatus during front surface sheet discharge.
Figure 4:
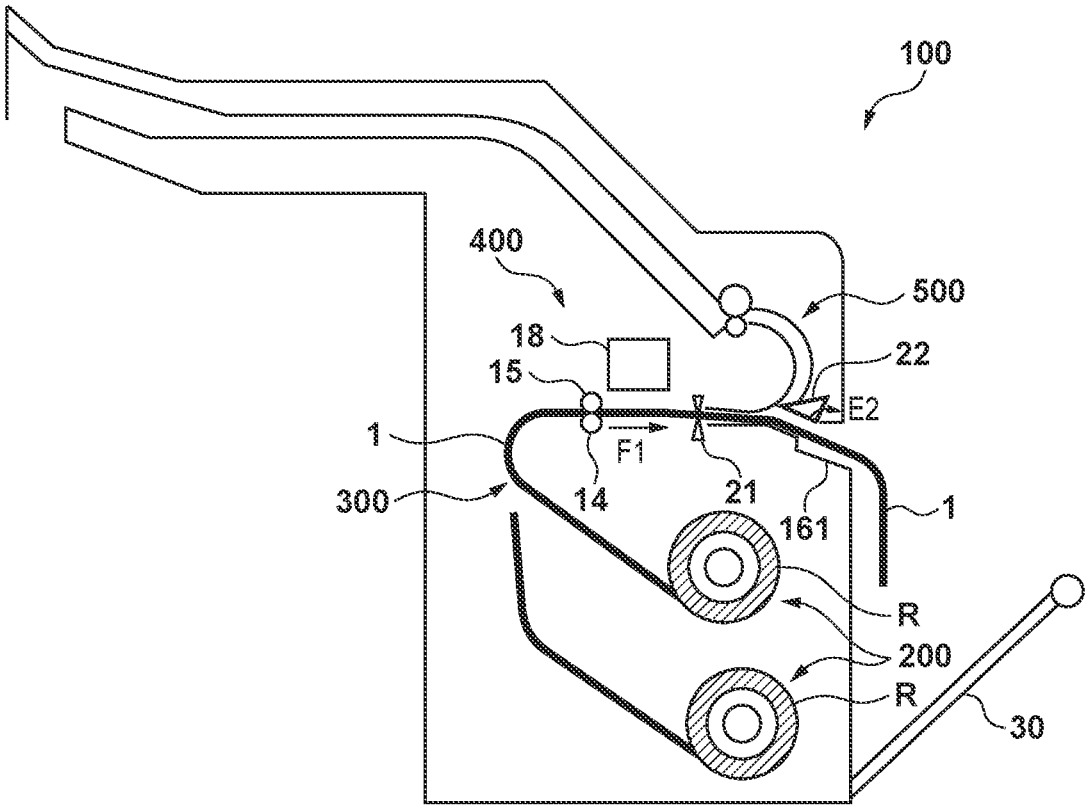
FIG. 4 is a view for describing a sheet conveyance path in a printing apparatus during front surface sheet discharge.

FIG. 3 is a schematic view of a front surface sheet discharge by the printing apparatus 100. The sheet 1, for which printing is completed, is discharged from a front surface sheet discharge supporting unit 161 set on a front surface portion of the printing apparatus 100. FIG. 4 is an overview cross-sectional view of front surface sheet discharge of a main part of the printing apparatus 100. The sheet discharge switching flap 22 arranged on the downstream side of the cutter 21 is positioned at a location where it is rotated in a direction of the arrow E2. The sheet 1, having passed through the sheet discharge switching flap 22, passes the top part of the front surface sheet discharge supporting unit 161 and is discharged at the front surface of the printing apparatus 100. The sheet 1, which is cut after the end of printing, is discharged by it's own weight, and is held in the front surface sheet discharge accommodation unit 30 where it can be pulled out from the bottom part of the printer.

Figure 5:
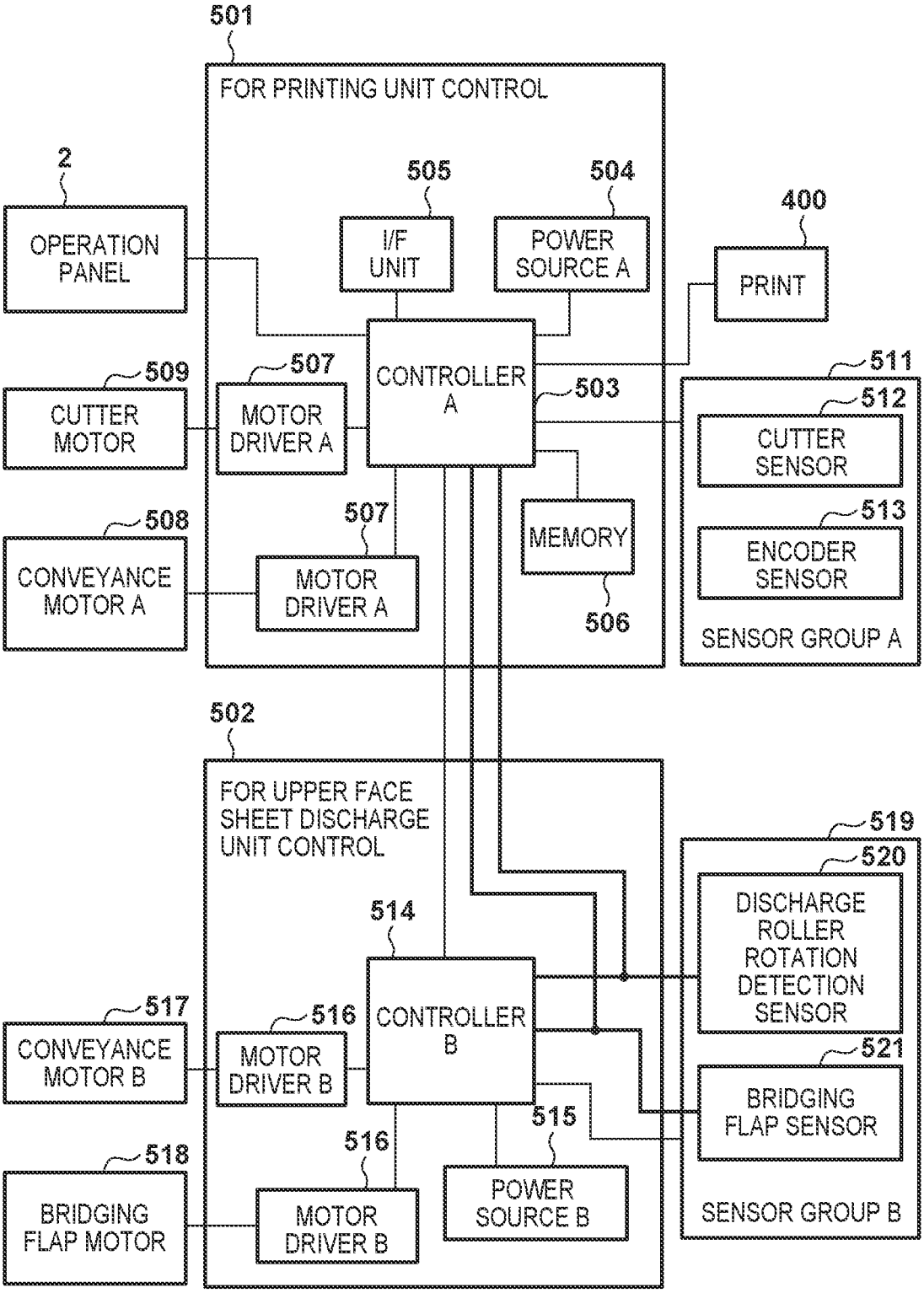
FIG. 5 is a block diagram for describing an electrical configuration of a printing apparatus in a first embodiment.

FIG. 5 is a block diagram for describing an electrical configuration of the printing apparatus 100. In the printing apparatus 100, a controller-board-for-controlling-the-printing-unit (circuit board) 501 and a controller-board-for-controlling-the-top surface-discharge-unit (circuit board) 502 are contained, and control each sensor and actuator.

A controller A503 is implemented in a controller-board-for-controlling-the-printing-unit 501, and a power source A504, an I/F unit 505, a memory 506, a motor driver A507, an operation panel 2, respective sensors, and the like are connected thereto. The power source A504 is constructed by circuitry for converting power supplied from an external unit into a voltage that is used for driving the controller-board-for-controlling-the-printing-unit 501 and each sensor and actuator.

An I/F unit 505 is constructed from a control circuit for a LAN, USB, or the like, and connects a PC and a network with the controller A503, and enables communication of data therebetween. The memory 506 is used for storing programs for driving the controller A503, particular tables, and other fixed data. Also, it is used for providing a region in which to deploy image data and a region for work and the like.

The motor driver A507 is a driving circuit for driving a conveyance motor A508 and a cutter motor 509, and receives control signals inputted from the controller A503 and outputs motor drive signals. The conveyance motor A508 drives and rotates the conveyance roller 14.

The printing unit 400 receives a control signal inputted from the controller A503, and in response to print data and the like, drives the printhead 18 to perform a print operation. A sensor group A511 is a group of detection sensors for detecting a state of an apparatus, and comprises a cutter sensor 512 mounted on the cutter 21, an encoder sensor 513 for detecting driving of the conveyance motor A508, and the like.

The operation panel 2 is a panel that the user operates to cause the printing apparatus 100 to operate, and is constructed by an LCD, a touch panel, a physical key, and the like. Menus and notifications are displayed on the LCD, and the user can start a scan operation and change settings by touch panel operations. Also, a start key, a stop key, and a sheet discharge key are provided as physical keys.

A controller B514 is implemented in a controller-board-for-controlling-the-top surface-discharge-unit 502, and is connected to the power source B515, the motor driver B516, respective sensors, and the like. A power source B515, similarly to the power source A504, is constructed by circuitry for converting power supplied from an external unit into a voltage that is used for driving a controller-board-for-controlling-the-printing-unit 502 and each sensor and actuator. The motor driver B516 is a driving circuit for driving the conveyance motor B (sheet discharge motor) 517 and a bridging flap motor 518, and receives control signals inputted from the controller B514 and outputs them to the motor drive signal. The sensor group B519 is a detection sensor group for detecting the state of the apparatus, and comprises a discharge roller rotation detection sensor 520 for detecting driving of a conveyance motor B517 mounted on the top surface discharge unit 500 and a bridging flap sensor 521 or the like for detecting driving (a state of movement of the bridging flap 40) of the bridging flap motor 518. The conveyance motor B517 drives and rotates the discharge roller 25 which % will be described later.

The controller-board-for-controlling-the-printing-unit 501 and the controller-board-for-controlling-the-top surface-discharge-unit 502 are connected, and are configured so as to control the controller-board-for-controlling-the-top surface-discharge-unit 502 by the controller-board-for-controlling-the-printing-unit 501. By arranging the controller-board-for-controlling-the-top surface-discharge-unit 502 separately from the controller-board-for-controlling-the-printing-unit 501, it is possible to independently control the top surface discharge unit and the printing unit.

Also, a signal line of the discharge roller rotation detection sensor 520 and the bridging flap sensor 521 is connected commonly to both the controller-board-for-controlling-the-printing-unit 501 and the controller-board-for-controlling-the-top surface-discharge-unit 502 (the bold lines in the figure). Output of the discharge roller rotation detection sensor 520 is used for control by the controller A503 for driving the conveyance motor A508 and control by the controller B514 for driving the conveyance motor B517. This driving control method will be described later. Output of the bridging flap sensor 521 is used to control driving by the controller A503 of the conveyance motor A508 and control driving by the controller B514 of the bridging flap motor 518. This driving control method will be described later.

Note that in the embodiment, the reason that the discharge roller rotation detection sensor 520 and the bridging flap sensor 521 are divided in the controller-board-for-controlling-the-top surface-discharge-unit 502 is as described below. Specifically, when a sensor signal to the controller-board-for-controlling-the-printing-unit 501 is transferred, by bundling it with other signals in the same harness, it is possible to reduce the number of harnesses. However, it is not absolutely necessary for the discharge roller rotation detection sensor 520 and the bridging flap sensor 521 to be divided by the controller-board-for-controlling-the-top surface-discharge-unit 502.

Next, using FIG. 6 to FIG. 12, an operation of a peripheral area of the cutter 21 in the embodiment will be described.

<Detailed Description of the Peripheral Area of the Cutter 21>

Figure 6:
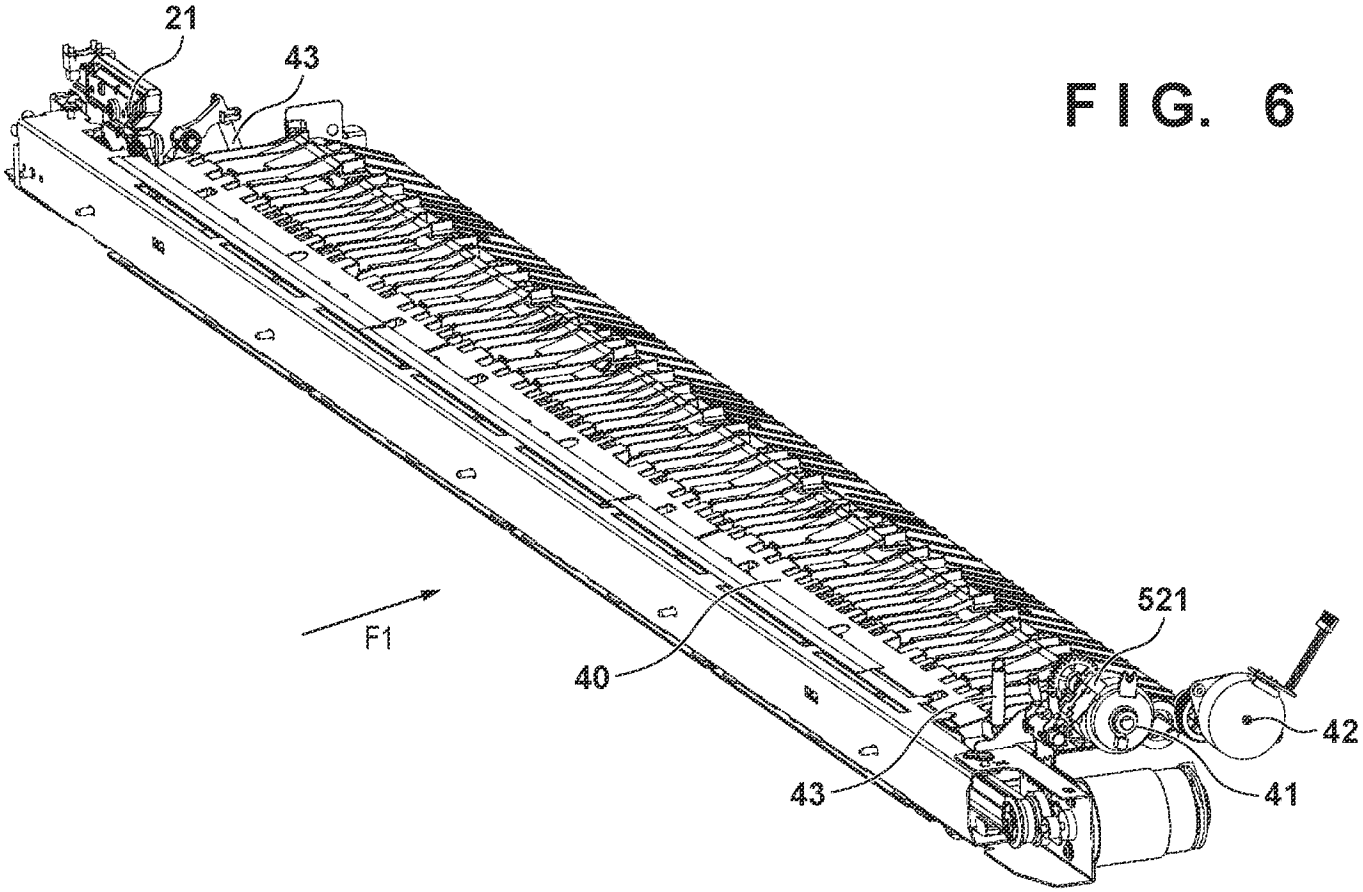
FIG. 6 is a perspective view of a peripheral area of a cutter.

FIG. 6 is a perspective view illustrating a detailed configuration of a peripheral area of the cutter 21.

The sheet 1, after passing through the printing unit 400, is conveyed in a direction indicated by an arrow F1 towards the cutter 21. A bridging flap 40, which forms a conveyance path for times when the cutter 21 forms is not operating and forms a travel path over which the cutter 21 is to travel for times when the cutter 21 is operating, is arranged on the downstream side of the cutter 21. A position of the bridging flap 40 is switched (can be moved) by a driving force transmission control unit 41, a driving source 42, and a biasing unit (biasing member) 43. In a case where the cutter 21 operates, the driving force generated by the driving source 42 is delivered to the bridging flap 40 via the driving force transmission control unit 41, and the position of the bridging flap 40 is switched, and the operation to cut the sheet 1 is performed. When the cutter 21 is not operating, the driving force transmission control unit 41 blocks the driving force from the driving source 42, and by a biasing unit 43, the position of the bridging flap 40 is switched, and a conveyance path is formed.

Next, overall operation in the peripheral area of the cutter 21 during a print operation will be described.

<Overall Operation of Peripheral Area of the Cutter 21 During a Print Operation>

Figure 7A:
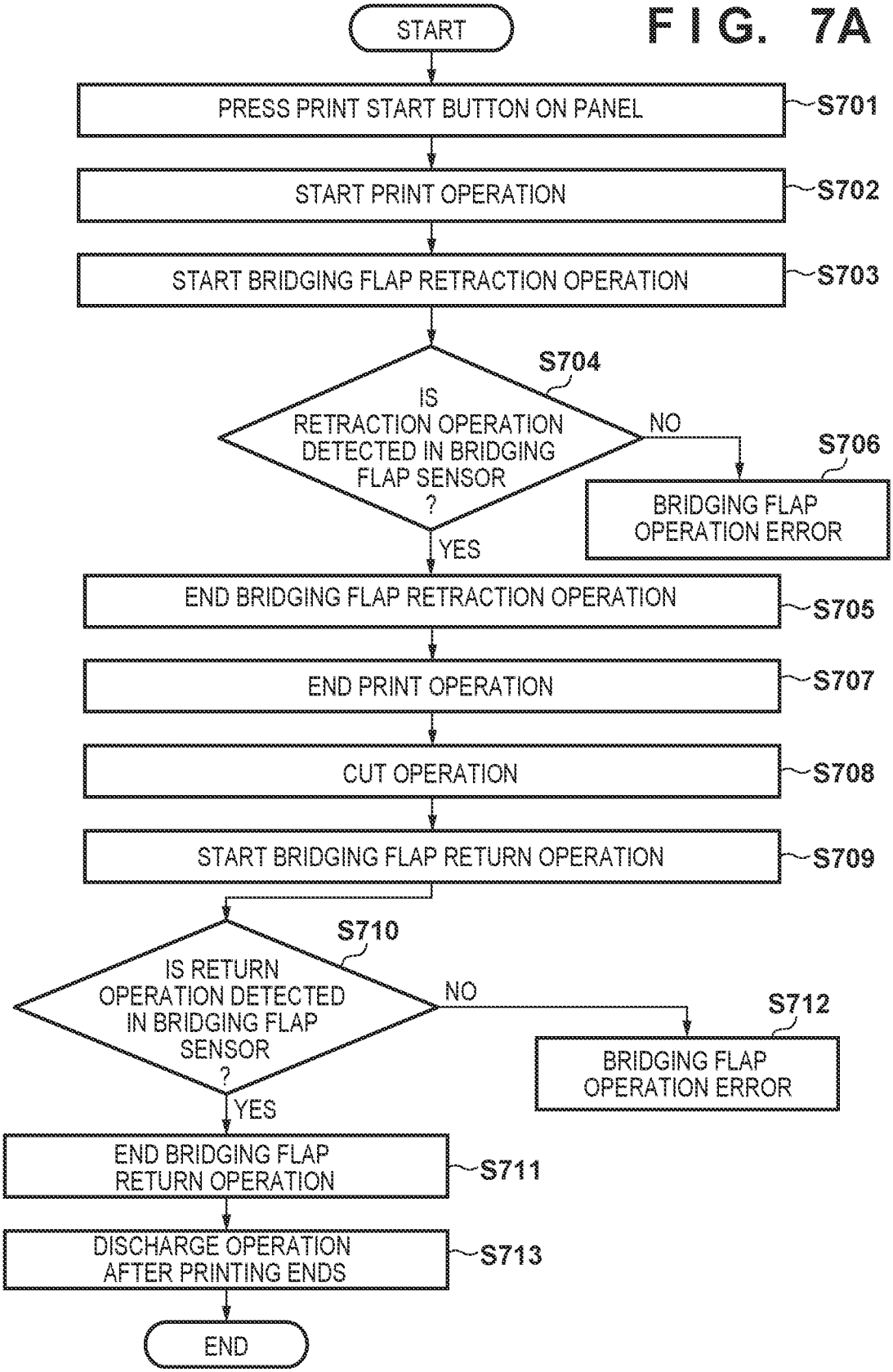
FIG. 7A is a flowchart for describing an operation of the printing apparatus in the first embodiment, focusing on a bridging flap operation.

FIG. 7A is a flowchart for describing a flow of operation from a print operation of the printing apparatus 100 of the embodiment to when a discharge is performed, focusing on a bridging flap operation. FIG. 7B is a view that describes a method for controlling each step of the sensor used in the embodiment.

In a case where the printing apparatus 100 performs a print operation, it is necessary to set a sheet roll R in the sheet supply apparatus 200 of the printing apparatus 100 in advance. In a state in which a roll R is set, an operation of the operation panel 2 is received, and a print setting change or the like is performed. After the print is setting change or the like is performed, a print start button is pressed by a user in order to perform a print operation (step S701).

When the print start button is pressed, the controller A503 transmits a control signal to a motor driver A507, and by causing the conveyance motor A508 to rotate, causes conveyance of the sheet 1 to start. Then, a printhead 180 is driven by the printing unit 400 in accordance with print data or the like, and printing is started (the step S702).

When printing is started, the controller B514 transmits a control signal to the motor driver B516, and causes rotation of the conveyance motor B517 also to start. When the leading edge of a printed sheet 1 exceeds the cutter 21 and enters the top surface discharge unit 500, the controller B514 transmits the control signal to the motor driver B516, and by causing the bridging flap motor 518 to rotate, causes a retraction operation of the bridging flap 40 to start (step S703). Detailed description of a retraction operation of the bridging flap 40 will be described later.

When the retraction operation of the bridging flap 40 is started, the retraction operation is detected by the bridging flap sensor 521 (the step S704). The sensor, controller, and motor used in step S704 are illustrated in FIG. 7B.

In step S704, when the retraction operation of the bridging flap 40 is detected, the retraction operation of the bridging flap 40 is ended (step S705). At this time, because the controller B514 immediately controls the bridging flap motor 518 when the bridging flap sensor 521 detects the retraction operation, it is possible to cause the retraction operation of the bridging flap 40 to end without delay.

In step S704, in the case where the retraction operation of the bridging flap 40 cannot be detected, the print operation is ended due to an operation error of the bridging flap 40, and through the operation panel 2 notifies that to the user (step S706).

In step S705, an operation to retract the bridging flap 40 ends, and if printing of print data and the like by the printing unit 400 has completed, the print operation is ended (step S707).

When the print operation ends, conveyance of the sheet 1 is stopped. The controller A503 transmits a control signal to the motor driver A507, and by causing the cutter motor 509 to rotate, causes an operation of the cutter 21 to be performed until the cut operation is detected by the cutter sensor 512 (step S708).

When the cut operation ends, the controller B514 transmits a control signal to the motor driver B516, and by causing the bridging flap motor 518 to rotate, causes a return operation of the bridging flap 40 to start (step S709). Detailed description of a return operation of the bridging flap 40 will be described later.

When the bridging flap 40 starts the return operation, the return operation of the bridging flap 40 is detected by the bridging flap sensor 521 (step S710). The sensor, controllers, and motors used in step S710 are illustrated in FIG. 7B.

In step S710, when the return operation of the bridging flap 40 is detected, the return operation of the bridging flap 40 is ended (step S711). At this time, because the controller B514 immediately controls the bridging flap motor 518 when the bridging flap sensor 521 detects the return operation, it is possible to cause the return operation of the bridging flap 40 to end without delay.

In step S710, in the case where the return operation of the bridging flap 40 cannot be detected, the print operation is ended due to an operation error of the bridging flap 40, and through the operation panel 2 notifies that to the user (step S712).

In step S711, when the return operation of the bridging flap 40 is ended, the discharge operation is performed after printing ends (step S713). At this time, because the controller A503 immediately controls a conveyance motor A508 when the bridging flap sensor 521 detects the return operation, it is possible to cause a paper feed operation to start after printing ends without delay.

As described above, by inputting the output of the bridging flap sensor 521 to the controller A503 and the controller B514, it is possible to control the actuators that the respective controllers are controlling individually. Hypothetically, if the bridging flap sensor 521 were connected only to the controller B514, the controller B514 would need to perform communication with the controller A503, and pass it signals for controlling the conveyance motor A508. Accordingly, a delay in the communication time between the controllers would arise. By using the configuration of the embodiment, it becomes possible to perform discharge processing after printing ends without producing a delay due to the bridging flap operation.

Next, operation by the cutter 21 at the time of printing will be described.

<Operation of the Cutter 21>

Figure 8:
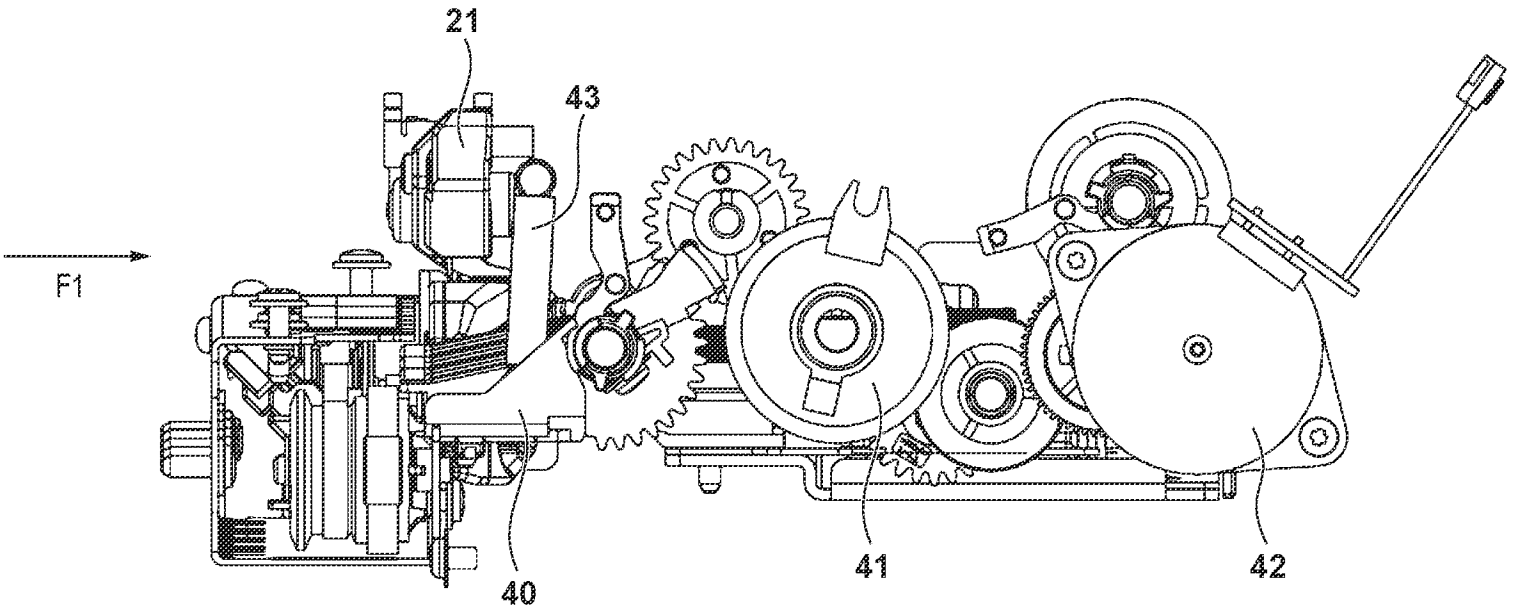
FIG. 8 is a view for describing a peripheral area of a cutter.
Figure 9:
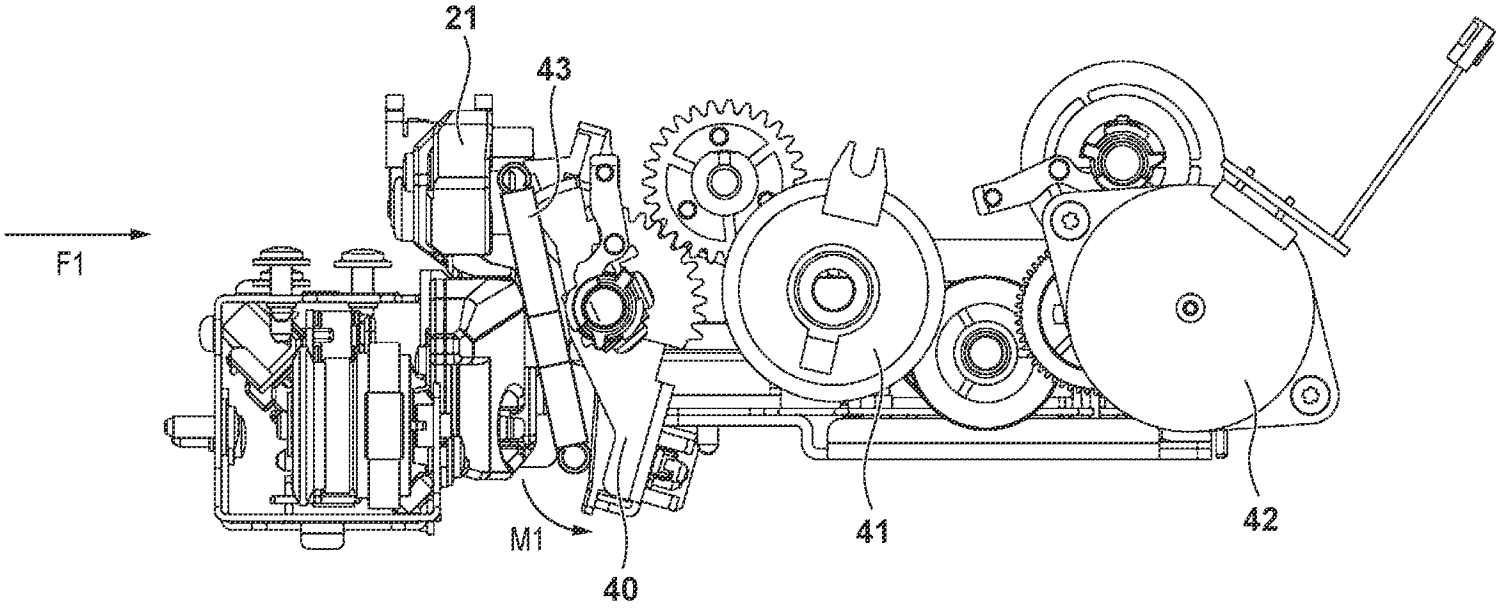
FIG. 9 is a view for describing a retracted state of a bridging flap.
Figure 10:
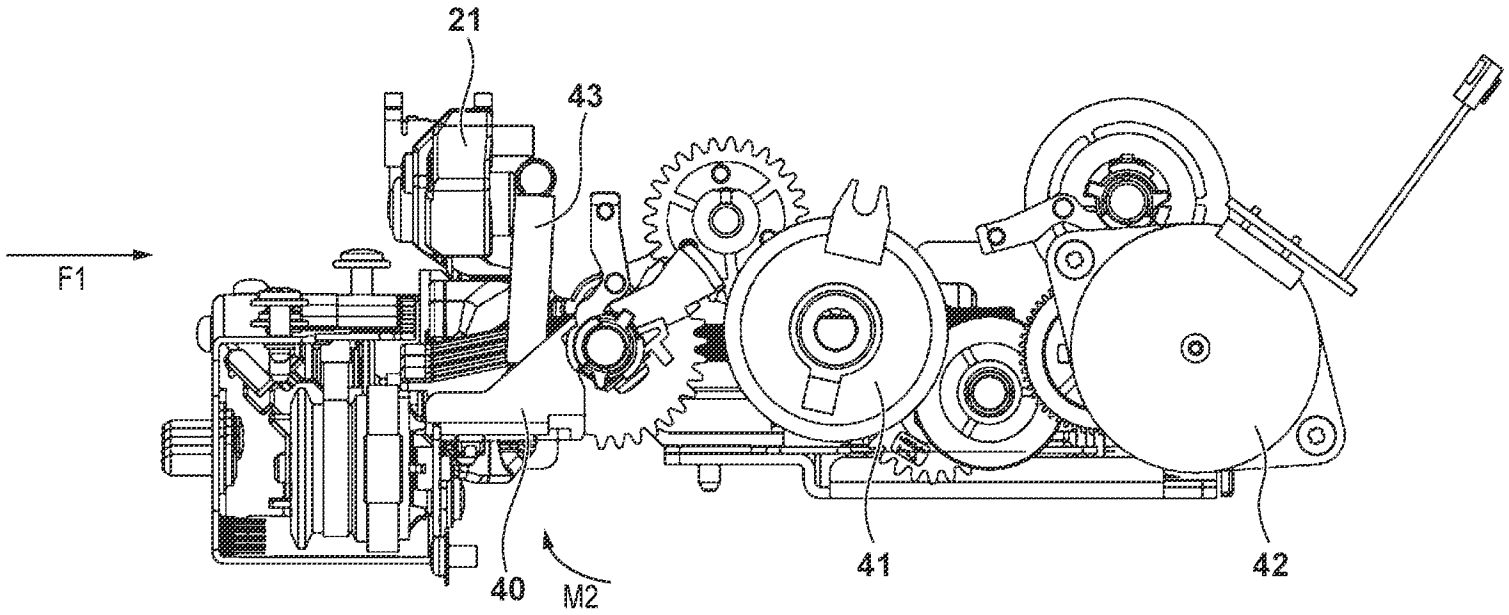
FIG. 10 is a view for describing a returned state of a bridging flap.

FIG. 8 to FIG. 10 are views illustrating an operation of the cutter 21. Control for executing an operation of the cutter 21 to be described below is performed by the controller A503 described previously.

When printing to the sheet 1 starts, the bridging flap 40 forms the conveyance path, and the cutter 21 is positioned to the outside of the bridging flap 40 in the width direction. When printing to the sheet 1 is started, and the leading end portion of the sheet 1 passes through the bridging flap 40, the driving source 42 is driven, and a driving force is delivered to the bridging flap 40 via the driving force transmission control unit 41, and it retracts in the direction indicated by the arrow M1 (refer to FIG. 9). After the bridging flap 40 moves to a predetermined position, the driving source 42 turns off, and by a driving force transmission control unit 42, the bridging flap 40 is held at the retracted position. By this, a travel path for the cutter 21 is formed. After a predetermined amount of the operation to print to the sheet 1 is performed, and the print operation ends, the sheet 1 is cut to a predetermined length. The cutter 21 travels in the width direction of the sheet 1, and after cutting the sheet 1, returns to an original position. Immediately after the cutter 21 returns to the original position, the holding of the bridging flap 40 by the driving force transmission control unit 41 is released, and it returns in the direction indicated by the arrow M2 due to the biasing unit 43 (refer to FIG. 10). The time that it takes for this operation is shorter than the movement time over which the flap 40 is driven by the driving source 42. After the sheet 1 is cut, the next print operation is started immediately, and therefore the bridging flap 40 returns within the sheet conveyance path at high speed prior to the leading end portion of the succeeding sheet entering into the position of the bridging flap 40. By this, it is possible to perform consecutive printing at high speed.

Figure 11:
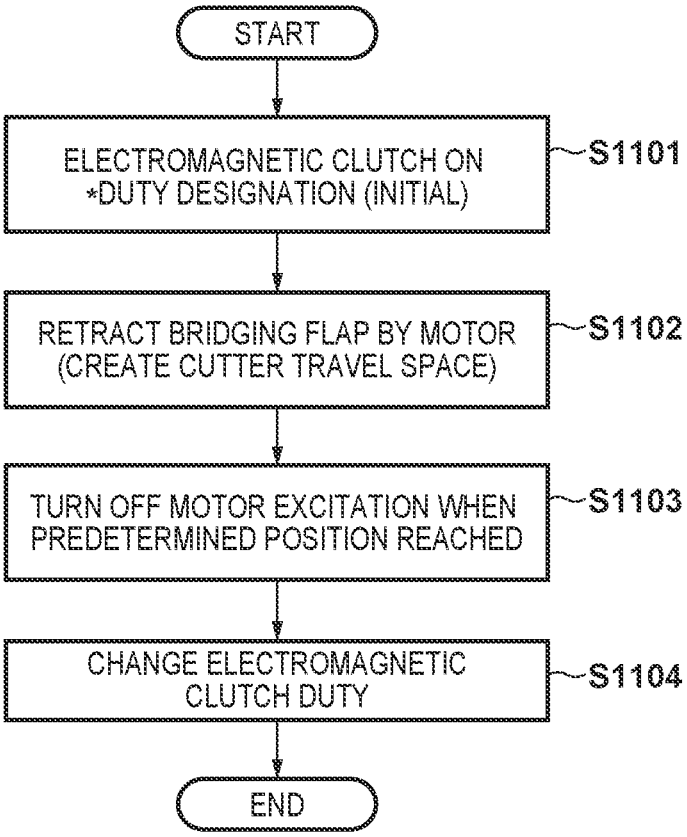
FIG. 11 is a flowchart for describing a retraction operation of the bridging flap.
Figure 12:
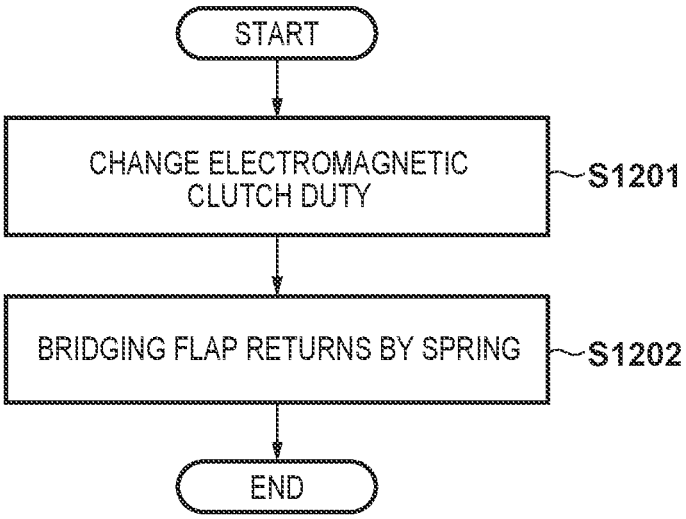
FIG. 12 is a flowchart is a description of a return operation of the bridging flap.

FIG. 11 and FIG. 12 are flowcharts that illustrate an operation of a peripheral area of the cutter 21. FIG. 11 is a flowchart for a time of a retraction operation of the bridging flap 40.

At the time when the retraction operation of the bridging flap 40 starts, the electromagnetic clutch is set to a predetermined duty (100%) by PWM control, and it is made possible to transmit to the bridging flap 40 a drive from the driving source 42 (motor) (step S1101).

After that, the driving source 42 is driven, and the bridging flap 40 retract in the direction indicated by the arrow M1 (step S1102).

After ending the retraction operation of the bridging flap 40, excitation of the driving source 42 (motor) is turned off (step S1103).

After that, the electromagnetic clutch is changed to a predetermined duty (50%), and the retraction of the bridging flap 40 ends (step S1104).

FIG. 12 is a flowchart for a time of a return operation of the bridging flap 40.

At the time of the start of the return operation of the bridging flap 40, the electromagnetic clutch is changed to a predetermined duty (0%) (step S1201).

After that, the bridging flap 40 starts to return in the direction indicated the arrow M2 by the force of the spring, returns to the predetermined position of the return operation, and ends the operation (step S1202).

Note that in the above-described embodiment, when returning in the direction indicated by the arrow M2 due to the biasing unit 43, the holding force is released by the driving force transmission control unit 41, but holding force may be controlled to change in a stepwise fashion. The bridging flap 40, immediately prior returning to the position for forming the conveyance path of the sheet 1, may decelerate the speed of the bridging flap 40 by again applying the released holding force, and thereby prevent a mechanical noise. In such a case, the bridging flap 40 decelerates to a speed that is not problematic in the formation of the conveyance path.

Next, using FIG. 13 to FIG. 17, operation of the peripheral area of the conveyance motor of the top surface discharge unit and the jam detection operation will be described.

<Jam Detection Unit Detailed Description>

Figure 13:
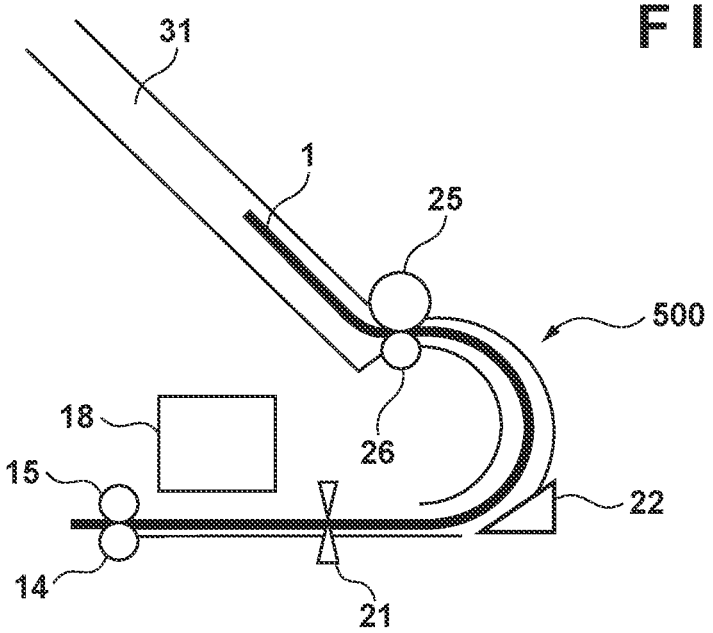
FIG. 13 is a view for illustrating a configuration of a peripheral area of a discharge roller.

FIG. 13 is a view illustrating a configuration of a peripheral area of the discharge roller 25.

The discharge roller 25 is configured to discharge the sheet 1 conveyed by the conveyance roller 14 to a top surface sheet discharge accommodation unit 31. The discharge roller 25 is connected with the conveyance motor B517 by a gear drive and is configured to rotate. A sheet discharge nip roller 26 is a driven roller, and is arranged in a pair with the discharge roller 25, and is constantly pressed to the discharge roller 25 by a spring or the like.

When printing is started, the discharge roller 25 starts rotating. As printing proceeds, the leading edge of the sheet 1 passes through the conveyance path and is sandwiched by the discharge roller 25 and the sheet discharge nip roller 26 and conveyed. Here, the discharge roller 25 constantly rotates at a faster speed than the transport speed of the conveyance roller 14. This is because if the transport speed of the discharge roller 25 is slow when the sheet 1 is conveyed sandwiched between both the conveyance roller 14 and the discharge roller 25, slack occurs in the sheet portion between the conveyance roller 14 and the discharge roller 25, resulting in a jam. Meanwhile, if the sheet 1 is pulled taut by the two rollers, there is a possibility that it will cause damage to the sheet 1 due to the tension. Accordingly, a torque limiter 53 (refer to FIG. 14) is added to the driver unit of the discharge roller 25, and so it is possible to set an upper limit to the torque to transfer from the motor. A detailed configuration will be described later. By this, it is possible to regulate the upper limit on the tension on the sheet 1 by the discharge roller 25, and so it is possible to avoid damaging the sheet 1. Also, the frictional force due to the pressure of the sheet discharge nip roller 26 and a nip roller 15 is set so to be larger than the conveyance force that is generated when the discharge roller 25 rotates at the upper limit of the torque limiter 53.

When printing ends, the position the sheet 1 to be cut is conveyed to the position of the cutter 21 after printing by the conveyance roller 14, and the cutting is executed. Here, the discharge roller 25 stops conveyance at the moment when the cutting is executed. This is because the cut precision would be degraded if the sheet 1 were pulled by the discharge roller 25 during cutting. After cutting ends, the discharge roller 25 starts rotating again, and discharges the printed sheet 1 to the top surface sheet discharge accommodation unit 31.

Figure 14:
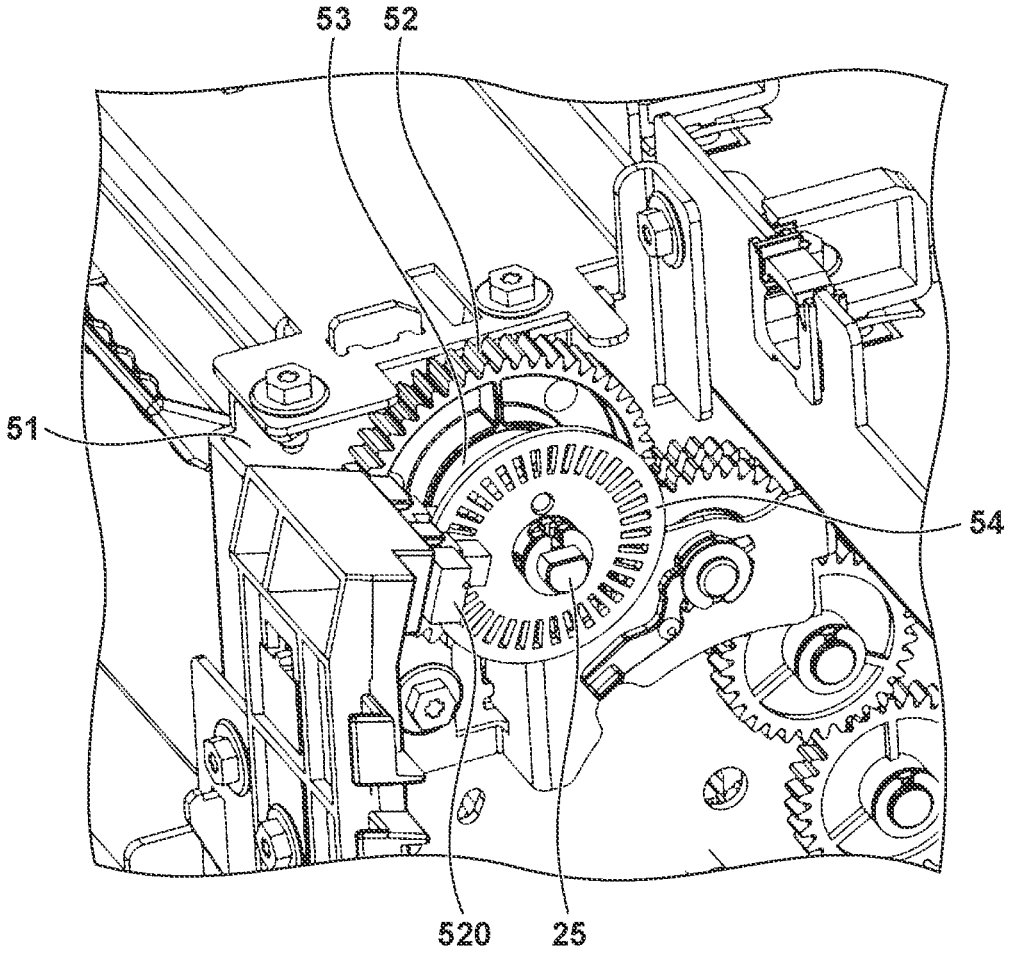
FIG. 14 is a view for illustrating a configuration of a jam detection unit.

FIG. 14 is a view illustrating a configuration of the jam detection unit.

One end of the discharge roller 25 is supported pivotably by a bearing or the like on a side plate 51 of the unit. An end portion of the discharge roller 25 extends from the side plate 51 to the outside of the unit, and a driving gear 52 is arranged coaxially to the axis of the discharge roller 25. Here, the axis of the discharge roller 25 and the axis of the driving gear 52 do not move together, and are configured to be able to pivot independently of each other. Adjacent to the driving gear 52, the torque limiter 53 is arranged. On the driving gear 52 and the torque limiter 53 a groove shape and projecting shape are formed respectively, and the driving gear 52 and the torque limiter 53 fit together and rotate together.

Adjacent to the torque limiter 53, a jam detection component 54 in which a slit for detecting rotation of the discharge roller 25 is formed is arranged. In the torque limiter 53 and the jam detection component 54 a projecting shape and a groove shape are formed respectively, and the torque limiter 53 and the jam detection component 54 fit together and rotate together.

Also, at the end of the discharge roller 25 and the central attachment hole of the jam detection component 54, a D-cut shape is formed, and the discharge roller 25 and the jam detection component 54 are configured to rotate together. As a result, the driving gear 52 rotates by the conveyance motor B517, and the power thereof, via the torque limiter 53, is transferred to the jam detection component 54, and the discharge roller 25 that is integrated with the jam detection component 54 is driven rotatably.

Here, the torque limiter 53 is configured to be able to set an upper limit to the torque transferred from the motor. Accordingly, if the torque needed for rotating the discharge roller 25 becomes larger than the value of the torque limiter 53, the torque limiter 53 rotates idling, and the discharge roller 25 does not rotate.

Also, the setting value of the torque limiter 53 is set so as to satisfy the following condition. The condition is that there is no damage to the sheet 1 when the tension is produced, that no slipping occurs in the nip portion between the conveyance roller 14 and the nip roller 15, and that a conveyance error does not occur due to conveyance resistance when the sheet 1 passes through the top surface sheet discharge accommodation unit 31.

The slit is formed in the jam detection component 54 and it rotates together with the discharge roller 25. The discharge roller rotation detection sensor 520, which is a photointerruptor for projecting light and receiving light is arranged in relation to this slit. By detecting light blocking and transmission pulses by the slit, it is possible to detect the amount of rotation of the discharge roller 25 using the discharge roller rotation detection sensor 520. In the embodiment, a component on which a general-purpose resin is formed is used for the jam detection component 54, and therefore the slit width is wide and coarse. However, in the case where more precise reading is necessary, the slit portion may be produced with a code wheel, and configured to be able to obtain a sensor value at a high frequency as with an encoder sensor.

<Overall Operation of Top Surface Discharge Unit Conveyance Motor Peripheral Portion>

Figure 15A:
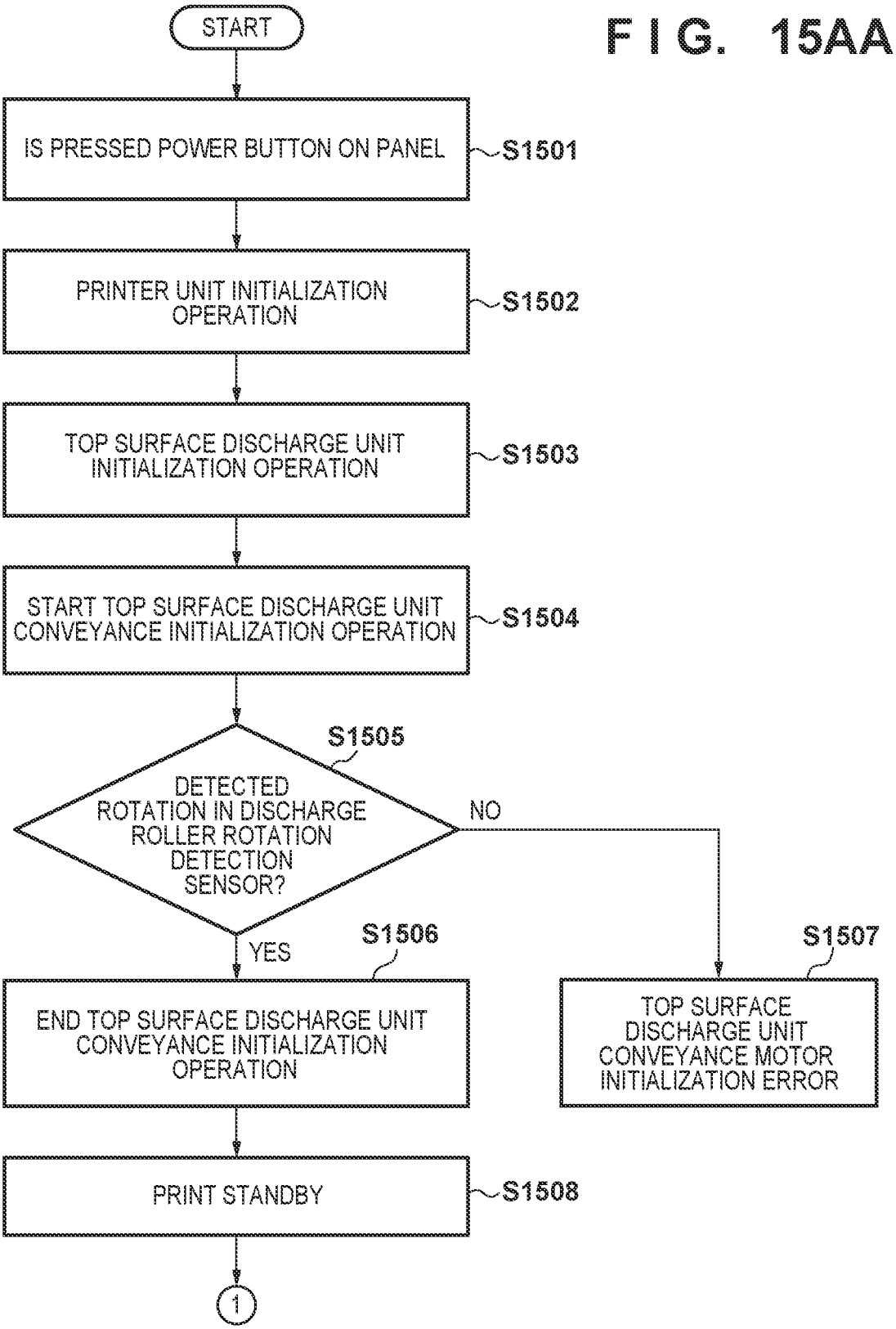
FIGS. 15AA and 15AB are flowcharts for describing a flow of printing apparatus operations focusing on operation of a top surface discharge unit conveyance motor.
Figure 15A:
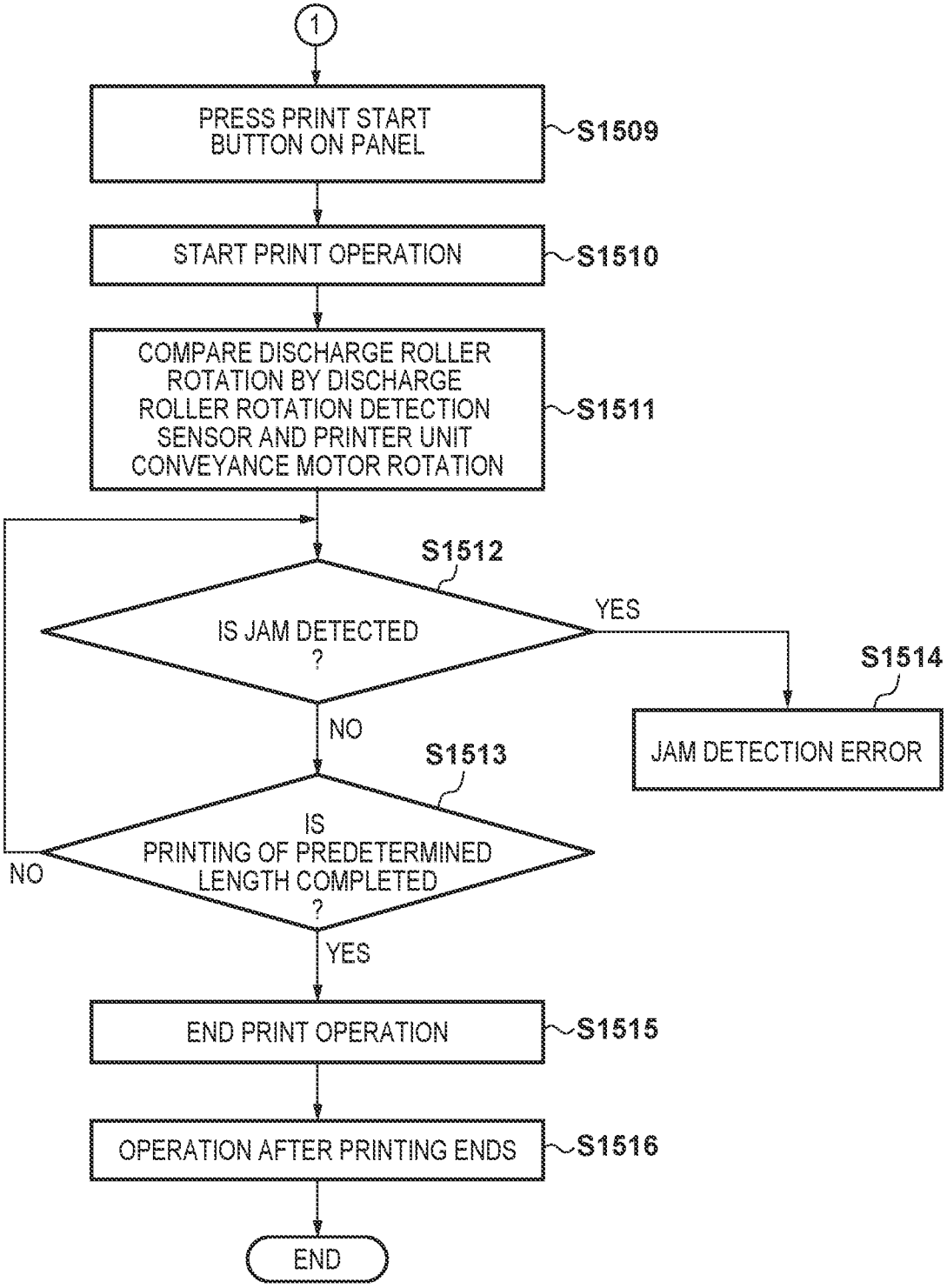

FIGS. 15AA and 15AB are flowcharts that are for describing a flow of operation from when the power of the printing apparatus 100 of the embodiment is turned on, to printing, and then to discharge, focusing on the operation of the conveyance motor B517 of the top surface discharge unit. FIG. 15B is a view for describing the method for controlling each step of the sensor used in the embodiment.

The printing apparatus 100 is activated by the power button on the operation panel 2 being pressed by the user (step S1501).

When the printing apparatus 100 is activated, the initialization operation of a print function portion such as the printing unit 400, the conveyance motor A508 and the like, is performed (step S1502).

Next, the initialization operation of the top surface discharge unit 500 is executed (step S1503). In the initialization operation of the top surface discharge unit 500, the conveyance motor B517 is caused to rotate by the controller B514, and a conveyance initialization operation is caused to start (step S1504).

When the conveyance initialization operation is started, rotation of the conveyance motor B517 is detected by the discharge roller rotation detection sensor 520 (step S1505). The sensor, controller, and motor used in step S1505 are illustrated in FIG. 15B.

When rotation of the conveyance motor B517 is detected in step S1505, the conveyance initialization operation is ended (step S1506). At this time, the controller B514 controls the conveyance motor B517 immediately when the discharge roller rotation detection sensor 520 detects rotation of the discharge roller 25, and can cause the conveyance initialization operation to end without delay.

In step S1505, in the case where it is not possible to detect rotation of the conveyance motor B517, the initialization operation is ended as an initialization error of the conveyance motor of the top surface discharge unit, and that is notified to the user through the operation panel 2 (step S1507).

When the conveyance initialization operation ends in step S1506, the print standby state is entered, and in the operation panel 2, print settings, print start, and the like are possible (step S1509).

In a case of performing a print operation, it is necessary to set a sheet roll R in the sheet supply apparatus 200 of the printing apparatus 100 in advance. After the print is setting change or the like is performed in the state where the roll R of the sheet 1 has been set, a print start button is pressed by a user in order to perform a print operation (step S1509).

When the print start button is pressed, the controller A503 transmits a control signal to a motor driver A507, and by causing the conveyance motor A508 to rotate, causes conveyance of the sheet 1 to start.

Then, the printhead 180 is driven by the printing unit 400 in accordance with print data or the like, and printing is started (the step S1510).

When printing is started, the controller B514 transmits a control signal to the motor driver B516, and causes rotation of the conveyance motor B517 also to start. The discharge roller rotation detection sensor 520 detects rotation of the conveyance roller, and the leading edge of the printed sheet 1 goes past the cutter 21 and enters the top surface discharge unit 500, and approaches the discharge roller 25, the discharge roller 25 is rotated. The discharge roller rotation detection sensor 520 detects rotation of the discharge roller 25. Jam detection is performed by the discharge roller rotation detection sensor 520 comparing rotation by the discharge roller 25 of the top surface discharge unit and the conveyance roller 14 of the printing unit (step S1511). The sensor, controller, and motor used in step S1511 are illustrated in FIG. 15B.

By the comparison of step S1511, it is determined (step S1512) whether the difference in the amount of rotation is not equal to or greater than a fixed amount, and if not, printing is continued (step S1513).

In step S1512, in the case where there is a difference of a fixed amount or more in the amount of rotation, the print operation is ended as a jam detection error, and that is notified to the user via the operation panel 2 (step S1514). At this time, when the discharge roller rotation detection sensor 520 and the encoder sensor 513 detect a rotation of the roller, the controller A503 can immediately compare the amount of rotation of the discharge roller 25 of the top surface discharge unit and the conveyance roller 14 of the printing unit and execute the jam detection without delay. Details of the jam detection operation will be described later.

When printing of a predetermined length completes in step S1513, the print operation is ended (step S1515). When the print operation ends, as operations for after the end of print operation, a cutting operation and a discharge operation are performed (step S1516).

As described above, by inputting the output of the discharge roller rotation detection sensor 520 into the controller A503 and the controller B514, it is possible to control the actuators that each controller is controlling individually. Hypothetically, if the discharge roller rotation detection sensor 520 is connected to only the controller B514, the controller B514 must perform communication with the controller A503, and notify the amount of rotation of the top surface discharge unit discharge roller 25 to the controller A503. Accordingly, a delay in the communication time between the controllers would arise. By using the configuration of the embodiment, it becomes possible to execute the jam detection operation without delay.

<Jam Detection Unit Operation>

Figure 16A:
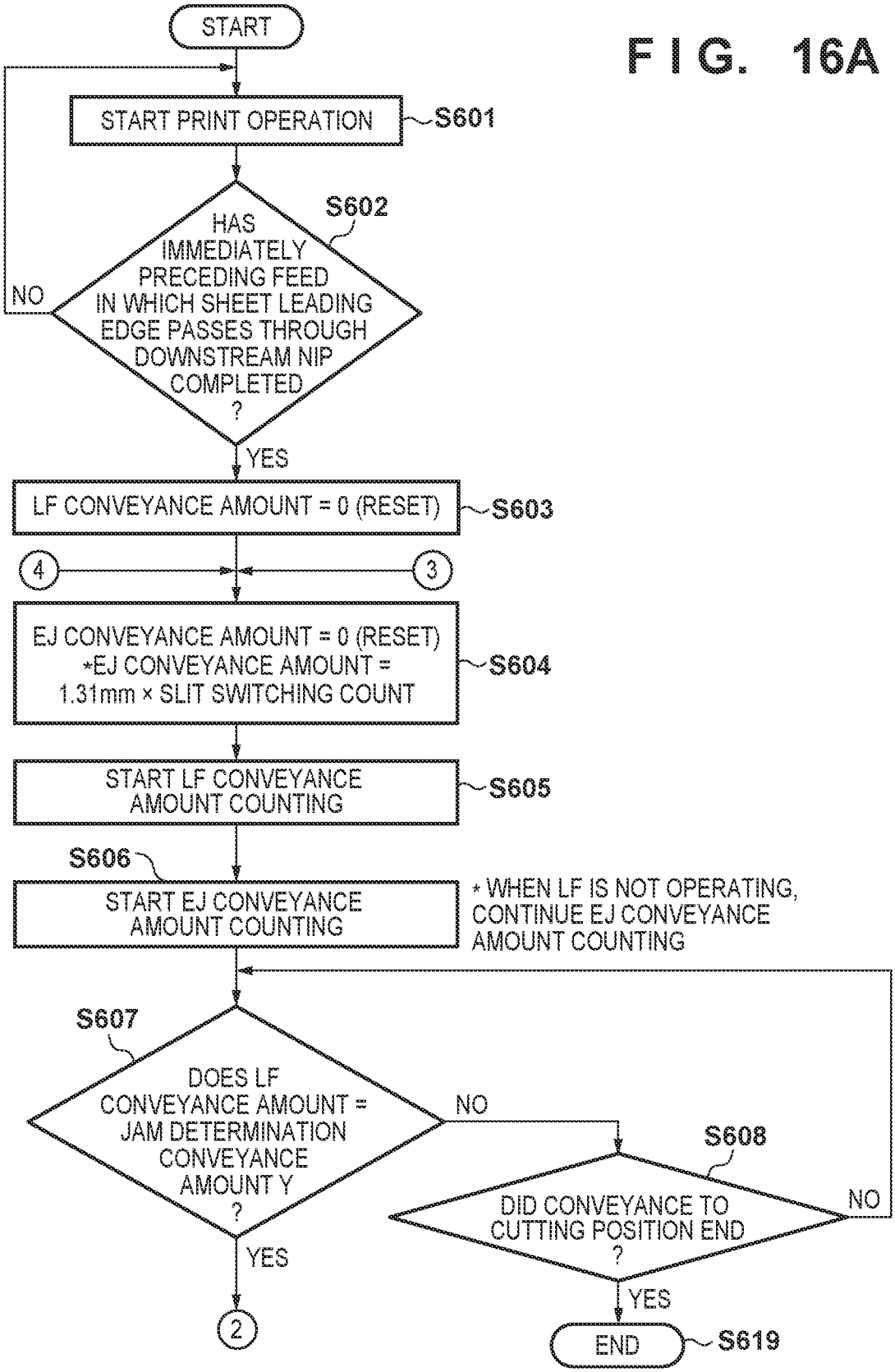
FIGS. 16A and 16B are flowcharts for describing a flow of printing apparatus operations focusing on a jam detection operation.
Figure 16B:
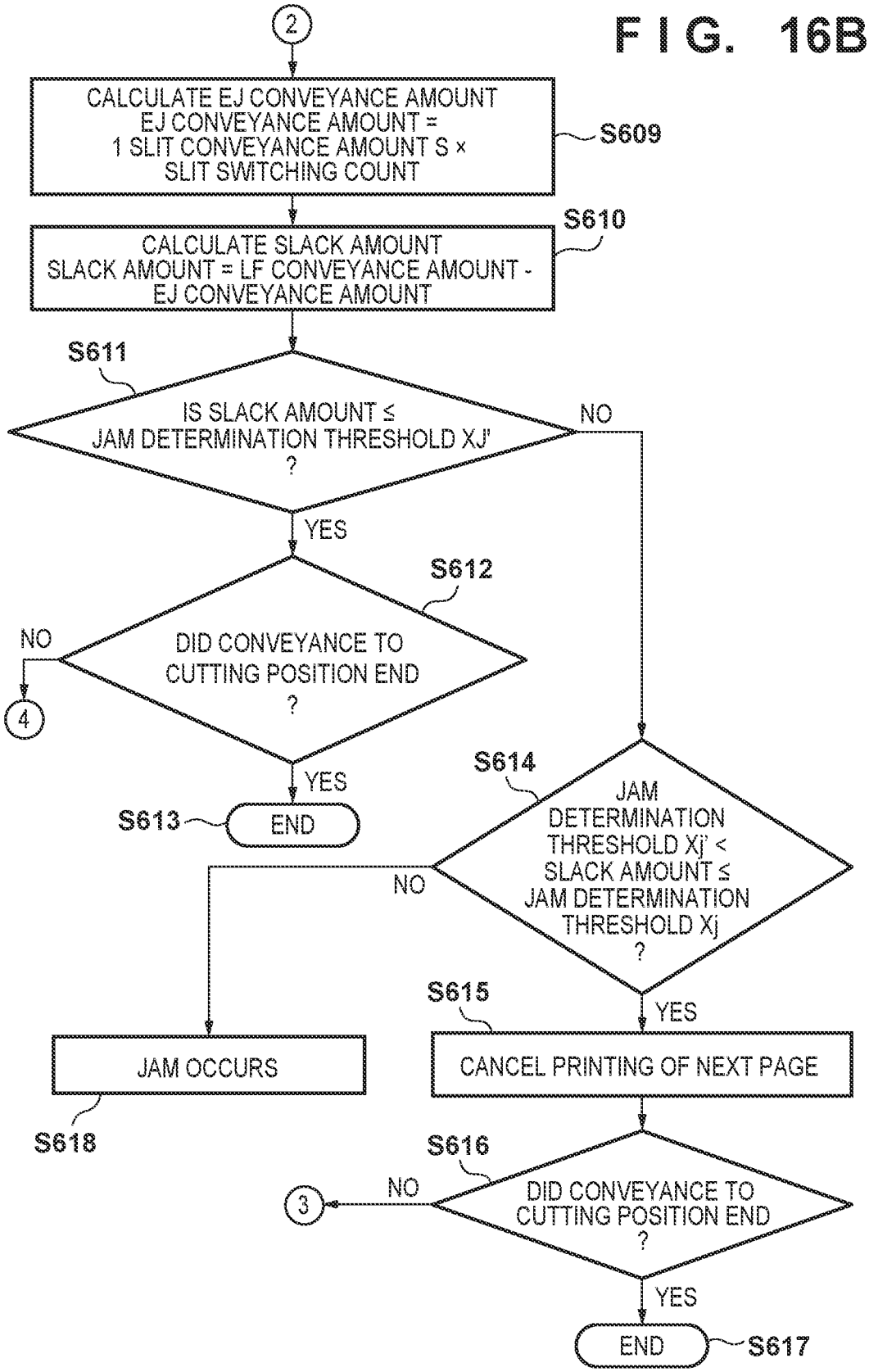
Figure 17:
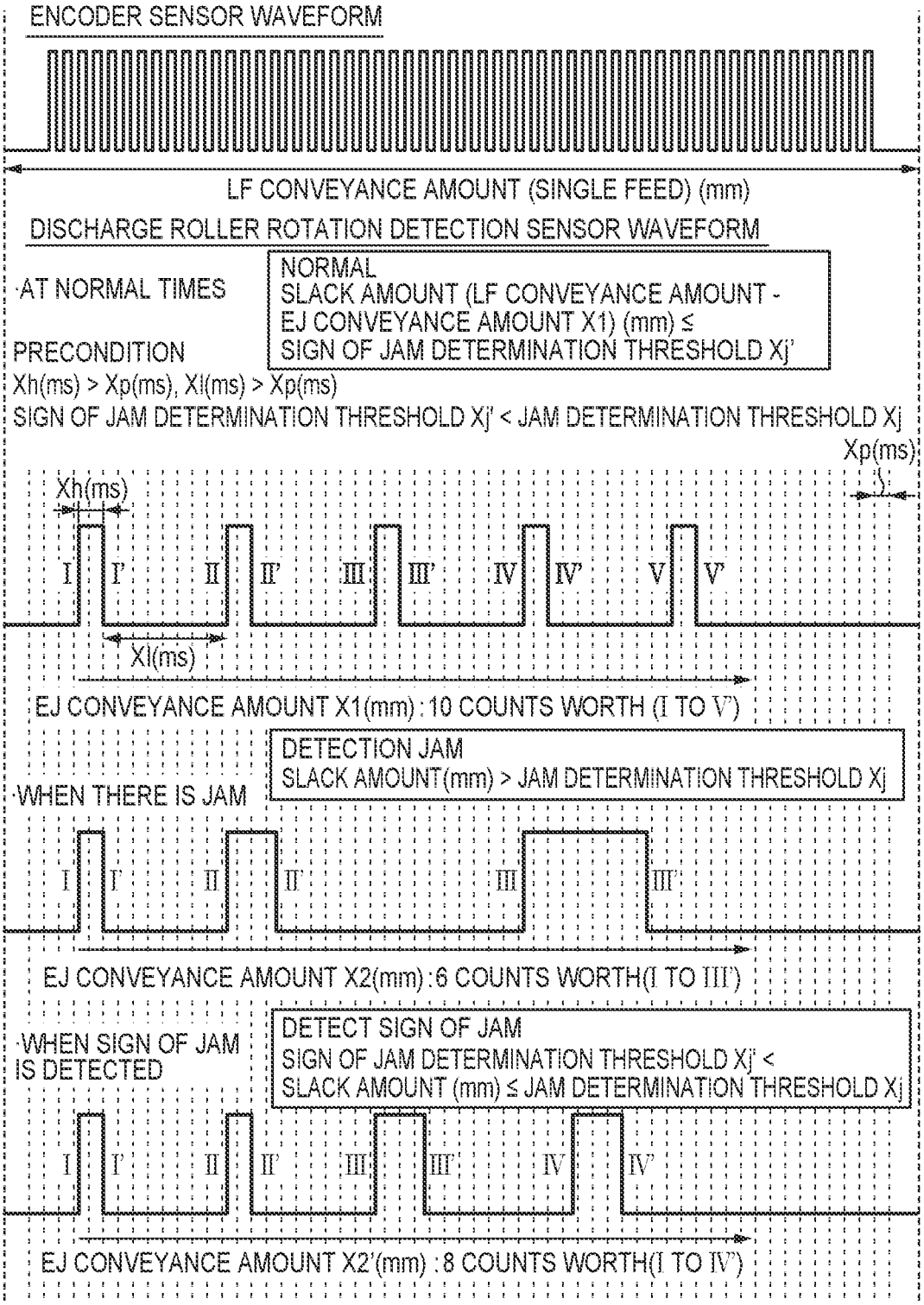
FIG. 17 is a view illustrating a method of calculating a waveform representing a jam detection flow.

Using FIG. 16A to FIG. 17, a flow of jam detection by the jam detection unit will be described. FIGS. 16A and 16B are flowcharts that focus on the jam detection operation, and FIG. 17 illustrates a method for calculating a waveform that represents the course of jam detection. Note that printer side conveyance will be denoted LF and the top surface sheet discharge side conveyance will be denoted EJ in the explanation.

In step S601, the print operation is started, and jam detection is started (step S602) when the immediately preceding feed in which the leading edge of the sheet 1 passes through the downstream nip (the discharge roller 25) completes. In other words, jam detection is performed in a nipped state at the LF and the EF. The encoder sensor 513 which detects the operation of the conveyance motor A508 which is controlled by the controller A503 and the discharge roller rotation detection sensor 520 which detects operation of the discharge roller 25 which is a driver unit of the conveyance motor B517 which is controlled by the controller B514 are used for sensor signals for performing the jam detection.

In step S602, when the jam detection is started, the controller A503 and the controller B514 reset (step S603) the LF conveyance amount held internally to 0, and reset (step S604) the EJ conveyance amount to 0.

Thereafter, the start counting the LF conveyance amount and the EJ conveyance amount (step S605 and step S606). Here, the counting of the EJ conveyance amount continues when the LF is not operating. The LF conveyance amount performs counting by a value obtained by the encoder sensor 513. The EJ conveyance amount performs counting by a value obtained by the discharge roller rotation detection sensor 520.

By the value obtained by the encoder sensor 513, it is determined in step S607 whether the LF conveyance amount has reached the jam determination conveyance amount Y, and if it has reached it, the EJ conveyance amount is calculated (step S609) by the value obtained by the discharge roller rotation detection sensor 520 at that point in time. In the case where it has not been reached, it is confirmed (step S608) whether or not conveyance to the cutting position has ended, and if it has not ended, printing and jam detection are continued. If it has ended, the jam detection is ended.

In step S609, the EJ conveyance amount is calculated. With the EJ conveyance amount, when the conveyance amount for 1 slit of the discharge roller rotation detection sensor 520 is made to be S, the calculation can be performed by multiplying the number of slit switches. The slack amount is calculated (step S610) from the difference of the EJ conveyance amount calculated with the LF conveyance amount, and processing is changed in response to the slack amount.

In step S611, in the case that the slack amount is less than or equal to jam determination threshold Xj', it is determined to be normal printing, and if conveyance to the cutting position has not ended (step S612), printing continues. In step S611, in the case where the slack amount is greater than the JAM determination threshold Xj', the processing proceeds to S614.

In step S614, it is determined to be a sign that a jam has started in the case where the slack amount is greater than the jam determination threshold Xj' and less than or equal to the jam determination threshold Xj, and the in-progress printing continues and the next printing is caused to stop. In such a case, it is expected that the print material discharged to the top surface sheet discharge accommodation unit 31 will exceed a full load or that discharging will be difficult due to the type of sheet 1, winding diameter, or environment. Accordingly, a display is made to the display panel 2 so that the sheets 1 stacked in the top surface sheet discharge accommodation unit 31 are removed. After it is confirmed that the stacked sheets are removed, the next printing is resumed. By this, it is possible to prevent the occurrence of a jam in advance.

If the slack amount is larger than the jam determination threshold Xj, it is determined (step S618) that a jam occurred, and printing is caused to stop immediately.

Here, in the embodiment, at the timing at which the LF conveyance amount reaches the jam determination conveyance amount Y, the EJ conveyance amount is calculated, but the distance thereof can be changed according to the resolution of the discharge roller rotation detection sensor 520. In the embodiment, since the resolution of the discharge roller rotation detection sensor 520 is coarse, an error can easily occur in the EJ conveyance amount and the slack amount. Accordingly, the LF conveyance amount to be determined is set to be large, and the error ratio is made smaller.

Next, using FIG. 17, the course of the jam detection will be described using a signal waveform of the sensor. Because the discharge roller rotation detection sensor 520 detects rotation of the jam detection component 54 attached to the discharge roller 25, its signal waveform, as illustrated in FIG. 17, is a waveform that switches regularly between high and low as does a rectangular wave. The signal obtained by the discharge roller rotation detection sensor 520 is inputted to the controller B514, and by polling at the frequency Xp (ms), the controller B514 obtains a sensor value. At this time, the high section Hh(ms) and the low section Hl(ms) must be small in relation to the polling period Xp(ms) as a countermeasure to missing a read.

A method of calculation when the jam determination conveyance amount Y=10 mm, the conveyance amount T for one slit of the discharge roller rotation detection sensor 520 is =1.0 mm, the jam determination threshold Xj'=1 mm, and the jam determination threshold Xj=3 mm is shown.

First, normal operation will be described. At normal times, the discharge roller 25 is rotating at a fixed speed, and the signal waveform of the discharge roller rotation detection sensor 520 switches periodically between high and low. According to the sensor value that the controller B514 polls, the high/low switching is counted (I to V'), and it is determined to be 10 counts in FIG. 17. In the controller B514, the movement amount in accordance with the count is calculated from the movement amount in relation to one count portion, and the EJ conveyance amount X1 (mm) and slack amount are calculated.

*EJ* conveyance amount *X*1=1.0 mm×10 switches=10.0 mm

Slack amount (jam determination conveyance amount *Y*−*EJ* conveyance amount *X*1) (mm) =mm 0 mm□jam determination threshold *Xj*'(1.0 mm)

Accordingly, it is determined to be normal and the printing is continued.

Next, operation when detecting a sign of a jam will be described. According to the sensor value that the controller B514 polled, switches between high and low are counted (I to IV'), and 8 count portions are determined in FIG. 17. In the controller B514, the movement amount in accordance with the count is calculated from the movement amount in relation to one count portion, and the EJ conveyance amount X1 (mm) and slack amount are calculated.

*EJ* conveyance amount *X*1=1.0 mm×8 switches=8.0 mm

Slack amount(jam determination conveyance amount *Y*−*EJ* conveyance amount *X*1) (mm)=2.0 mm Since the jam determination threshold Xj' (1.0 mm)<the slack amount (2.0 mm) Q the jam determination threshold Xj (3.0 mm), it is determined to be a detection of a sign of a jam, and the print material that is currently being printed is continued, but the next print is caused to stop. Then, after allowing the user to remove the sheets stacked on the top surface sheet discharge accommodation unit 31, printing is caused to resume.

Next, an operation for when it is detected that a jam occurred will be described. By the sensor value that the controller B514 polled, the high/low switching is counted (I to III'), and it is determined to be 6 count portions in FIG. 17. In the controller B514, the movement amount in accordance with the count is calculated from the movement amount in relation to one count portion, and the EJ conveyance amount X1 (mm) and slack amount are calculated.

*EJ* conveyance amount *X*1=1.0 mm×6 switches=6.0 mm

The slack amount (the jam determination conveyance amount *Y*−*EJ* conveyance amount *X*1) (mm)=4.0 mm Because the slack amount (4.0 mm)>the jam determination threshold Xj (3.0 mm), it is determined that a jam has occurred, and the current printing is immediately cause to stop.

Note that in the embodiment, as the method for controlling the controller B514, a sensor value is obtained by polling, but if an interrupt control is used, it is not necessary for the high section Hh(ms) and the low section HI(ms) to be small in relation to the polling period Xp(ms).

Also, in the description of FIG. 17, the case where the jam determination threshold Xj'=1 mm and the jam determination threshold Xj=3 mm was described, but if the conveyance path of the printer is different or the like, the optimal value of the threshold will change. Thus, optimization in accordance with the actual printing apparatus is necessary.

As described above, by changing the processing for detecting a sign of a jam and for detecting a jam depending on the slack amount, it is possible to avoid the occurrence of a jam in advance, and so it is possible to reduce print material waste.

Second Embodiment

In the first embodiment, jam detection is performed for each jam determination conveyance amount Y, but in the second embodiment, jam detection by accumulation is described. Using FIG. 18A to FIG. 19, the jam detection by accumulation in the embodiment will be described.

<Jam Detection Unit Operation>

Using FIG. 18A to FIG. 19, the flow of jam detection by accumulation by the jam detection unit will be described.

The reason for executing jam detection by accumulation is that with only detection of each jam determination conveyance amount Y, it is possible to detect the case where a jam occurred immediately, and it is not possible to detect that a conveyance amount has fallen gradually. For example, in the first embodiment, in the case of a slack amount of 2.0 mm, it is determined that a sign of a jam is detected when the jam determination threshold Xj' (1.0 mm)<the slack amount (2.0 mm) □the jam determination threshold Xj (3.0 mm). However, when this situation is continued, the slack amount accumulates, and a jam will occur prior to the page currently being printed ending. In the embodiment, to be able to detect a jam even in such a situation, jam detection by accumulation is also executed.

Figure 18A:
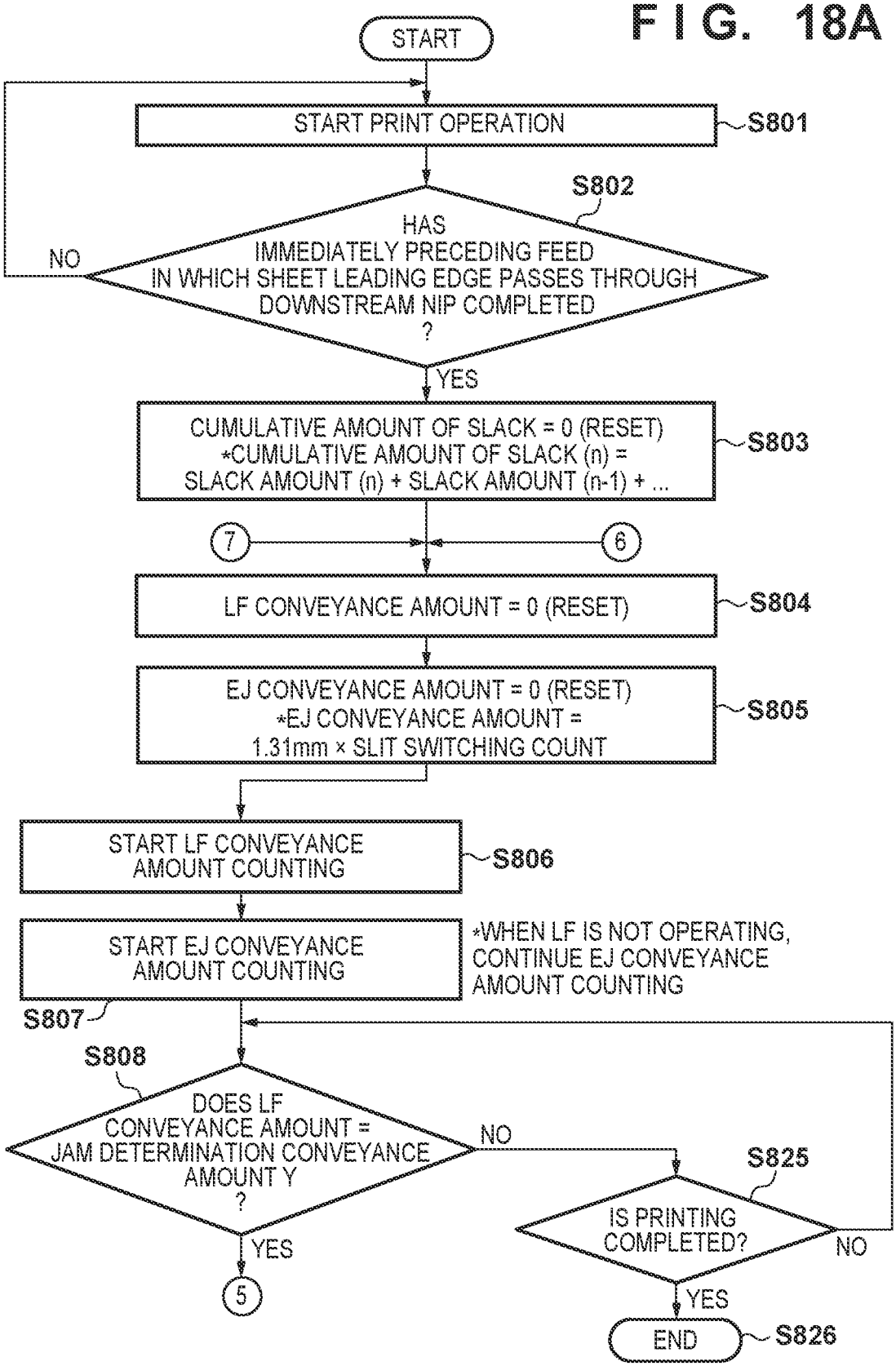
FIGS. 18A and 18B are flowcharts illustrating an accumulation jam detection operation in a second embodiment.
Figure 18B:
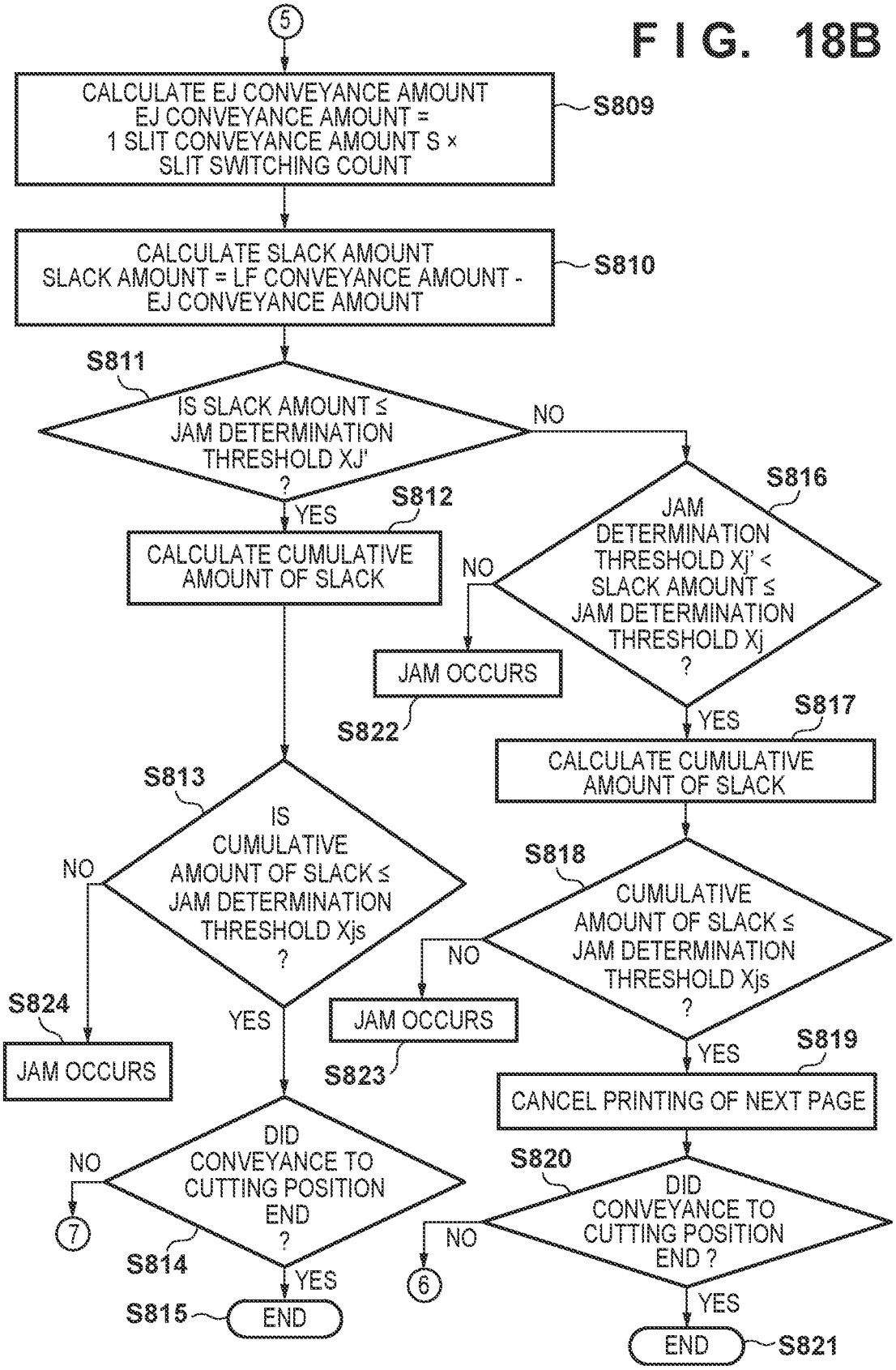
Figure 19:
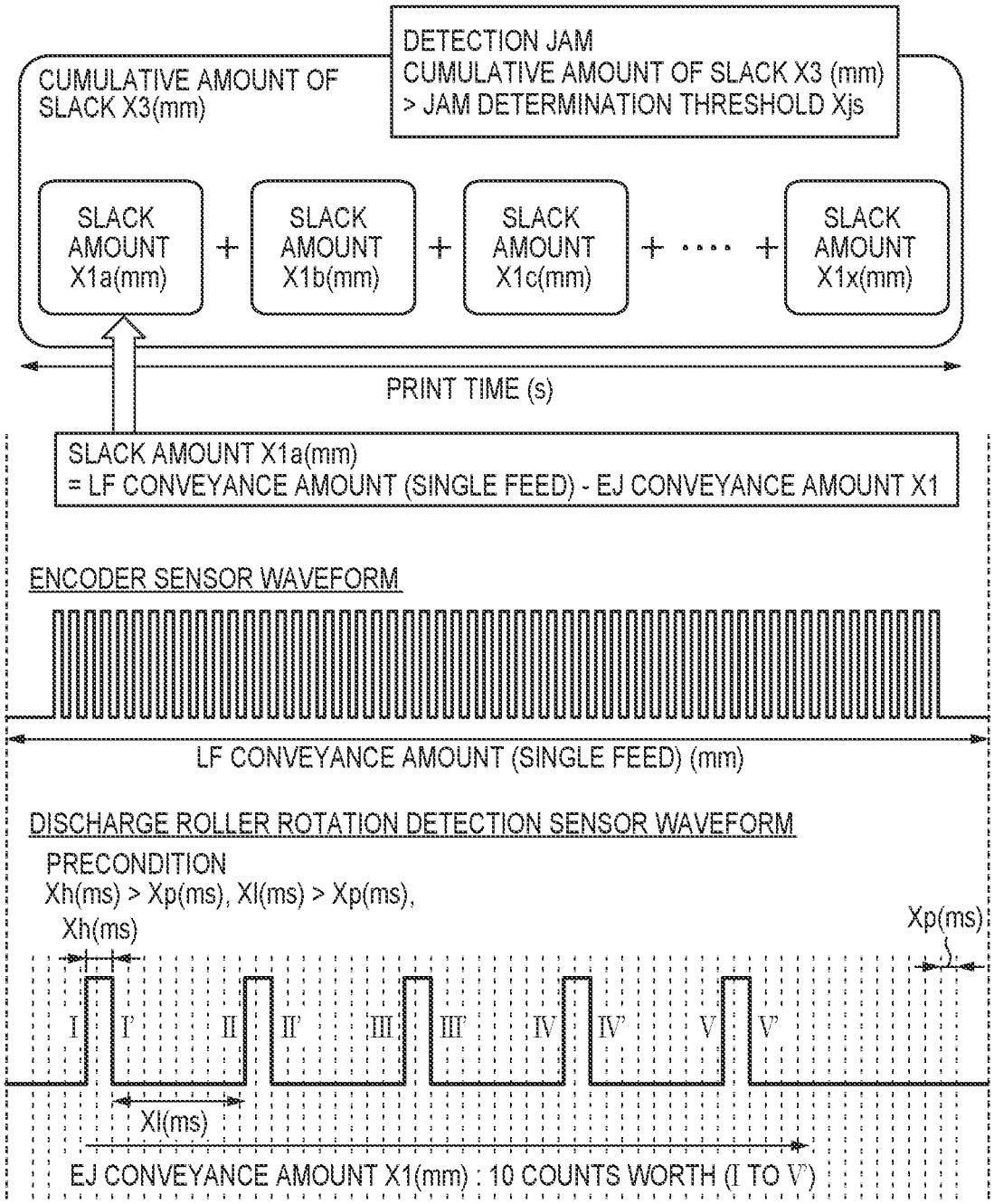
FIG. 19 is a view illustrating a method for calculating a waveform representing an accumulation jam detection flow.

FIGS. 18A and 18B illustrate flowcharts focusing on an accumulation jam detection operation, and FIG. 19 illustrates a method o calculating a signal waveform that represent the course of accumulation jam detection. Note that printer side conveyance will be denoted LF and the top surface sheet discharge side conveyance will be denoted EJ in the explanation of this embodiment.

The jam detection of the embodiment will be performed after the jam detection described in the first embodiment. The basic jam detection method is similar to in the first embodiment, and so description thereof will be omitted.

A jam determination is executed according to the first embodiment, and if normal is determined, the cumulative amount of slack is calculated (step S812 and step S817). As illustrated in FIG. 19, the cumulative amount of slack X3(mm) is calculated by adding the slack amount X1a(mm) to X1x(mm) calculated for the jam determination conveyance amount Y during printing.

Next, comparing the calculated cumulative amount of slack X3(mm) with the jam determination threshold Xjs (mm), print processing is changed depending on the size. Here, since it is necessary to set the jam determination threshold Xjs (mm) to equal to or less than a slack amount that can be absorbed within the sheet conveyance path, it is necessary to optimize in response to the actual sheet conveyance path of the printing apparatus.

Because it is possible to absorb a cumulative amount of slack X3(mm) on the sheet conveyance path in the case where the cumulative amount of slack X3(mm)<the jam determination threshold Xjs(mm), floating paper does not occur on the platen, and jams due to the carriage and the print material interfering do not occur. Accordingly, normal is determined, and printing continues.

Meanwhile, in the case where the cumulative amount of slack X3(mm) 7 the jam determination threshold Xjs(mm), with the cumulative amount of slack X3(mm) that cannot be absorbed on the sheet conveyance path, floating paper occurs on the platen, and due to interference with the carriage, a jam occurs. Accordingly, it is determined that a jam occurs, and the printing is caused to stop immediately (step S823).

Reset of the cumulative amount of slack X3 is executed if the print operation ends, and the immediately preceding feed in which the leading edge of the next sheet passes through the downstream nip completes.

Also, in the case where the slack accumulation occurring on the sheet conveyance path is fed suddenly due to minute slipping occurring in the EJ nipping portion or conveyance resistance falling, there are cases where cumulative amount of slack X3 is a negative value. However, since such a phenomenon does not mean that there is slack, it is ignored in the embodiment.

As described above, by virtue of the second embodiment, since it is possible to detect a sign of a jam that cannot be detected by the first embodiment, it is possible to avoid jams in advance, and reduce waste of print material.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-166111, filed Sep. 30, 2020, which is hereby incorporated by reference herein in its entirety.

What is claimed is:

1. A printing apparatus comprising:

a printing unit configured to perform printing to a print medium;

a conveyance motor configured to drive a conveyance roller conveying the print medium to the printing unit;

a flap configured to move to a first position at which the flap supports the print medium and a second position at which the flap does not support the print medium;

a driving motor configured to move the flap between the first position and the second position; and a sensor configured to output a sensor signal used to control the conveyance motor and the driving motor.

2. The printing apparatus according to claim 1, further comprising:

a first circuit board configured to control the conveyance motor and the printing unit;

a second circuit board configured to control the driving motor; and a signal line configured to input the sensor signal from the sensor to the first circuit board and the second circuit board.

3. The printing apparatus according to claim 2, wherein the signal line, in the second circuit board, branches to a wire that supplies the sensor signal to the first circuit board.

4. The printing apparatus according to claim 2, further comprising a first driven roller configured to rotate following the conveyance roller, and a second driven roller configured to rotate following the discharge roller, wherein, in a state in which a print medium is sandwiched between the conveyance roller and the first driven roller and sandwiched between the discharge roller and the second driven roller, print processing of the print medium being printed and the print medium to be printed next are changed in accordance with a difference of a conveyance amount of the conveyance roller and a conveyance amount of the discharge roller.

5. The printing apparatus according to claim 4, wherein the discharge roller rotates at a faster conveyance speed than the conveyance roller.

6. The printing apparatus according to claim 4, further comprising a torque limiter configured to restrict an upper limit for torque by which the discharge roller is rotated, wherein a frictional force by which a print medium is sandwiched between the conveyance roller and the first driven roller and a frictional force by which a print medium is sandwiched between the discharge roller and the second driven roller are greater than a conveyance force occurring when the discharge roller rotates at the upper limit of the torque limiter.

7. The printing apparatus according to claim 1, further comprising a cutter arranged on a print medium conveyance path and configured to cut the print medium, wherein the flap capable of moving to the first position to form the print medium conveyance path and the second position to not form the print medium conveyance path in order to form a travel path for the cutter.

8. The printing apparatus according to claim 1, wherein a movement time from the second position to the first position of the flap is shorter than a movement time from the first position to the second position.

9. The printing apparatus according to claim 8, wherein movement of the flap from the first position to the second position is performed by the driving motor, and movement of the flap from the second position to the first position is performed by a biasing member.

10. The printing apparatus according to claim 9, further comprising a deceleration mechanism configured to, in a case where the flap is caused to move from the second position to the first position, cause the speed of the flap to be decelerated.

11. The printing apparatus according to claim 8, further comprising a cutter arranged on a print medium conveyance path and configured to cut the print medium, wherein the cutter, in a case where the flap is positioned in the second position, cuts a print medium.

12. The printing apparatus according to claim 8, further comprising a cutter arranged on a print medium conveyance path and configured to cut the print medium, wherein the flap, when a print medium enters a position at which the flap is arranged, is positioned in the first position, and after the print medium passes the position at which the flap is arranged, the flap moves to the second position, and after the cutter cuts the print medium, the flap moves to the first position.

13. The printing apparatus according to claim 1, wherein the sensor is a flap sensor configured to detect a state of movement of the flap.

14. A printing apparatus comprising:

a printing unit configured to perform printing to a print medium;

a conveyance motor configured to drive a conveyance roller conveying the print medium to the printing unit;

a discharge unit configure to discharge the print medium printed by the printing unit; a sheet discharge motor configured to drive a discharge roller arranged in the discharge unit;

a rotation detection sensor configured to detect a rotation of the discharge roller and to output a sensor signal used to control the conveyance motor and the sheet discharge motor.

15. The printing apparatus according to claim 14, further comprising:

a first circuit board configured to control the conveyance motor and the printing unit;

a second circuit board configured to control the sheet discharge motor; and a signal line configured to input the sensor signal from the rotation detection sensor to the first circuit board and the second circuit board, wherein the second circuit board controls the discharge unit.

16. The printing apparatus according to claim 15, wherein the rotation detection sensor is a second rotation detection sensor and the printing apparatus comprises a first rotation detection sensor, and wherein, based on a signal of the first rotation detection sensor supplied to the first circuit board and a signal of the second rotation detection sensor supplied to the first circuit board by the signal line that branches from the second circuit board, conveyance of a print medium by the conveyance motor and conveyance of a print medium by the sheet discharge motor are compared and a jam is thereby detected.

17. The printing apparatus according to claim 14, wherein the rotation detection sensor is a second rotation detection sensor and further comprising a first rotation detection sensor configured to detect a rotation of the conveyance motor, wherein, based on a signal of the first and second rotation detection sensors, conveyance of a print medium by the conveyance motor and conveyance of a print medium by the sheet discharge motor are compared, and a jam is thereby detected.

* * * * *